US005198794A

United States Patent [19]

Sato et al.

[11] Patent Number: 5,198,794

[45] Date of Patent: Mar. 30, 1993

[54] TRIMMED RESISTOR

[75] Inventors: Teruhiro Sato; Tomio Wada, both of Yokohama, Japan

[73] Assignee: Matsushita Electric Industrial Co., Ltd., Osaka, Japan

[21] Appl. No.: 672,935

[22] Filed: Mar. 21, 1991

[30] Foreign Application Priority Data

Mar. 26, 1990 [JP] Japan ..... 2-73239
Mar. 26, 1990 [JP] Japan ..... 2-73240
Jul. 30, 1990 [JP] Japan ..... 2-202114

[51] Int. Cl.[5] ..... H01C 10/46

[52] U.S. Cl. ..... 338/195; 338/306; 338/308; 338/325; 219/121.68

[58] Field of Search ..... 338/195, 306, 308, 325; 219/121.68, 121.69

[56] References Cited

U.S. PATENT DOCUMENTS 3,947,801 3/1976 Bube ..... 338/308
4,403,133 9/1983 Turner et al. ..... 338/195 X
4,443,782 4/1984 d'Orsay ..... 338/195
4,505,032 3/1985 Praria ..... 338/195 X
4,531,111 7/1985 Schmidt et al. ..... 338/195
5,051,719 9/1991 Gaston et al. ..... 338/195 X
5,057,964 10/1991 Bender et al. ..... 338/195 X

*Primary Examiner*—Marvin M. Lateef
*Attorney, Agent, or Firm*—Stevens, Davis, Miller & Mosher

[57] ABSTRACT

A trimmed resistor is provided which has no directional feature when used and is easily mounted on a printed base board. In the trimmed resistor, there are formed four external electrodes arranged at peripheral portions of a rectangular insulation base plate in a point symmetrical distribution about a center of the insulation base plate, a film-like resistance body connected with all of the external electrodes, and a protective film covering the film-like resistance body. Two electrodes among the above-mentioned four electrodes are used as resistor terminals, and a cut slit for trimming is formed in the resistance body longitudinally or as starting from a side of the electrodes serving as resistor terminals.

17 Claims, 20 Drawing Sheets

TRIMMED RESISTOR

BACKGROUND OF THE INVENTION

The present invention relates to a resistor, and in particular, to a trimmed resistor of a thick film type used in various electric equipments and to a trimmed resistor used in printed circuit boards of a hybrid integrated circuit.

A trimmed resistor means a resistor whose resistance value is adjusted by shaving off or cutting off a part of a film-like resistance body.

FIGS. 1*a* is a plan view of a conventional trimmed resistor of a thick film type in an operational condition and FIG. 1*b* is a sectional view of the resistor taken along the line I*b*—I*b* of FIG. 1*a*. The trimmed resistor of a thick film type comprises external electrodes 2 at both ends of an insulation base board 1 and a thick film-like resistance body 3 disposed on the surface of the insulation board 1 between the electrodes 2 and covered by a protective film 4. In general, the insulation base board 1 is made from an alumina plate, the external electrodes 2 from a conductive material of palladium-silver group, the thick film-like resistance body 3 from a resistive material of ruthenium oxide group and the protective film 4 from a glass having a low melting point.

A method, in other words, a fabricating and mounting method, of the thick film-like trimmed resistor constructed as mentioned above will be described below. Referring to FIGS. 1*a* and 1*b*, on a circuit pattern formed on an upper surface of a circuit board 5, there are formed soft soldering lands 6 by using an usual material and by applying an usual method, correspondingly to the external electrodes 2 locating at the both ends of the trimmed resistor of a thick film type. To these soft soldering lands 6 are connected the external electrodes 2 of the above-mentioned trimmed resistor of a thick film type with soft solder 7 by applying an usual soft solding method such as reflowing, solder dipping or use of a soft soldering tool. The resistance value can be adjusted by successively forming a cut slit 8 at the central portion of the thick film-like resistance body 3 by using an usual means such as a laser, a sand blast, and a cutter.

FIGS. 2*a* and 2*b* show a printed resistance circuit of a trimming type having a conventional thick film-like resistance body. Numeral 11 denotes an insulation base plate which is mainly made of alumina or the like. Electrode terminals 12*a* and 12*b* are formed on a surface of the insulation base plate by printing and baking palladium-silver group material thereon, and a thick film-like resistance body 13 is formed by printing and baking ruthenium oxide group material for connecting the above-mentioned electrode terminals 12*a* and 12*b* with each other. Trimming work is conducted by forming a cut slit at the central portion of the thick film-like resistance body 13 by an usual means such as a laser, a sand blast, and a cutter. Thus, the resistance value of the printed resistance circuit to be trimmed can be adjusted by controlling the depth of the slit 14 of the thick film-like resistance body 13.

The above-mentioned trimmed resistor of a prior art includes, however, the following problems:

1) When the depth of the slit in the resistance body is excessively increased, an electric current concentration may be caused at the remaining portion apart from cutting, thereby deteriorating the stability of the resistance value during a long time and decreasing the electric power capacity. As a result, it is difficult to obtain a wide range variation of the resistance value.

2) When the resistance body is completely cut off by accident, the resistance value becomes infinitely great, thereby causing a breakdown or an abnormal operation of some other part in an inconvenient case of circuit constitution.

SUMMARY OF THE INVENTION

A first object of the present invention is to provide a trimmed resistor which has a wide range of the resistance value variation and can be treated with respect to mounting work in the same manner as general parts having nondirectional feature.

A second object of the present invention is to provide a trimmed resistor which has a wide range of the resistance value variation and can be treated with respect to mounting work in the same manner as general parts having nondirectional feature and further assures an easy manufacturing of the resistor.

A third object of the invention is to provide a trimmed resistor in which the resistance value is variable from zero to a final resistance value.

A fourth object of the present invention is to provide an using method for a trimmed resistor in which a trimmed resistor can be treated with respect to mounting work in the same manner as an electrical part having nondirectional feature and the resistance body can be formed with a cut slit precisely at a predetermined position.

A fifth object of the present invention is to provide an using method for a trimmed resistor in which a trimmed resistor can be mounted in the same manner as an electrical part having nondirectional feature and the resistance body can be formed with a cut slit precisely at a predetermined position and further the resistance value does not become infinitely great even when the resistance body is completely cut off.

A sixth object of the present invention is to provide an using method for a trimmed resistor in which a trimmed resistor can be mounted in the same manner as an electrical part having nondirectional feature and the resistance body can be formed with a cut-slit precisely at a predetermined position and the resistance value does not become infinitely great even when the resistance body is completely cut off and further, the potential equilibrium relation between the external electrodes of a trimmed resistor can be adjusted in an arbitrary manner.

A seventh object of the present invention is to provide a printed resistance circuit of a trimming type in which the resistance value can be varied over a great range and does not become infinitely great even when the resistance body is completely cut off.

An eight object of the present invention is to provide a printed resistance circuit of a trimming type in which the resistance value can be varied over a great range and does not become infinitely great even when the resistance body is completely cut off and further, the electrodes can be formed easily.

A ninth object of the present invention is to provide a printed resistance circuit of a trimming type in which the resistance value can be varied from zero to a final resistance value.

A tenth object of the present invention is to provide a printed resistance circuit of a trimming type in which the resistance value can be varied over a great range and does not become infinitely great even when the resistance body is completely cut off and further the potential equilibrium relation between the external electrodes of a trimmed resistor can be adjusted in an arbitrary manner.

An eleventh object of the present invention is to provide a trimmed resistor in which no electric current concentration is caused at the remaining portion of the resistance body adjacent to the cut slit, even when the remaining portion is small and the resistance value does not become infinitely great even when the resistance body is completely cut off, and a great variation range of the resistance value can be obtained.

For achieving the above-mentioned objects of the present invention, a trimmed resistor according to the present invention comprises four external electrodes which are arranged at peripheral portions of a rectangular insulation base plate in a point symmetrical distribution about the center of the insulation base plate and a film-like resistance body which are adjacent to the external electrodes and covered by a protective film. Two of the above-mentioned electrodes are used as resistor terminals and a cut slit is formed in the resistance body longitudinally of the resistance body from one side corresponding to the opposed external electrodes constituting resistor terminals.

In consequence, by virtue of the above-mentioned construction, there is obtained a trimmed resistor having nondirectional feature and adapted to be easily mounted on the printed base board.

Further, as occasion demands, two electrodes, which are not used as resistor terminals, may be connected with each other. In this configuration, the electric current concentration at the remained portion of the resistance body can be relieved, even when the remained portion is small, because the electric current flows mainly through the above-mentioned connecting member which has a resistance value lower than that of the remained portion. In addition, even in case the resistance body is completely cut off by accident, the resistance value between the resistor terminals does not become infinitely great.

DESCRIPTION OF THE PREFERRED EMBODIMENTS

Figure 1A:
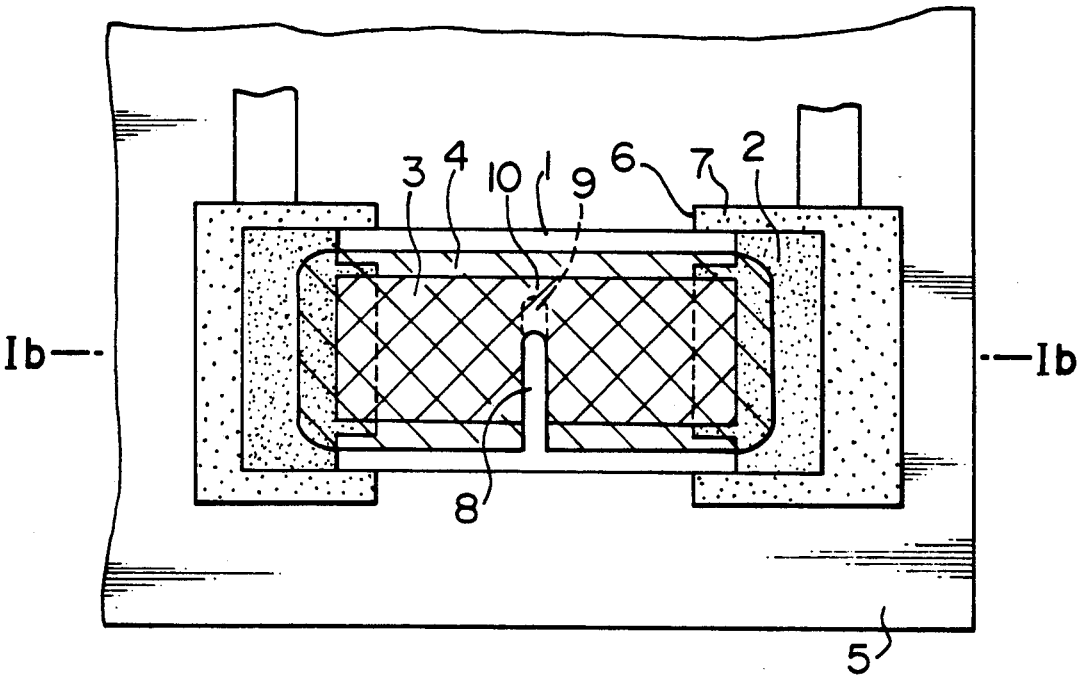
FIG. 1a PRIOR ART
FIGS. 1*a* is a plan view of a conventional trimmed resistor of a thick film type as being in use.
Figure 1B:
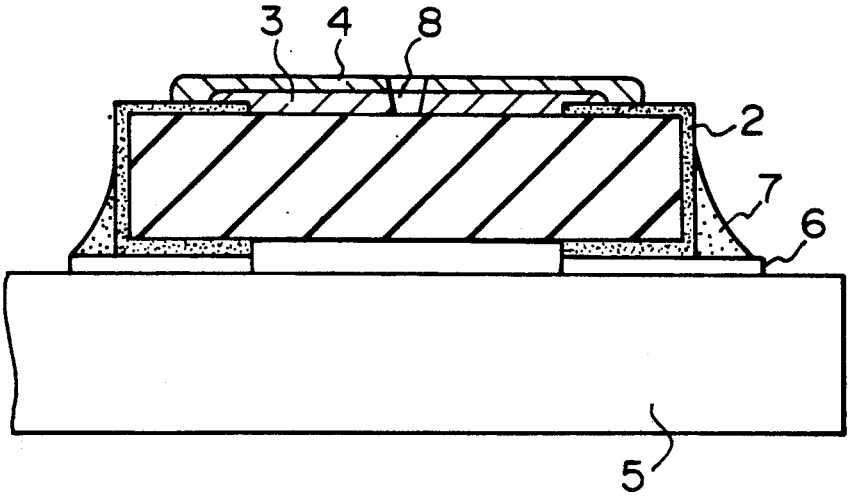
FIG. 1b PRIOR ART
FIG. 1*b* is a sectional view taken along the line I*b*—I*b* of FIG. 1*a*.
Figure 2A:
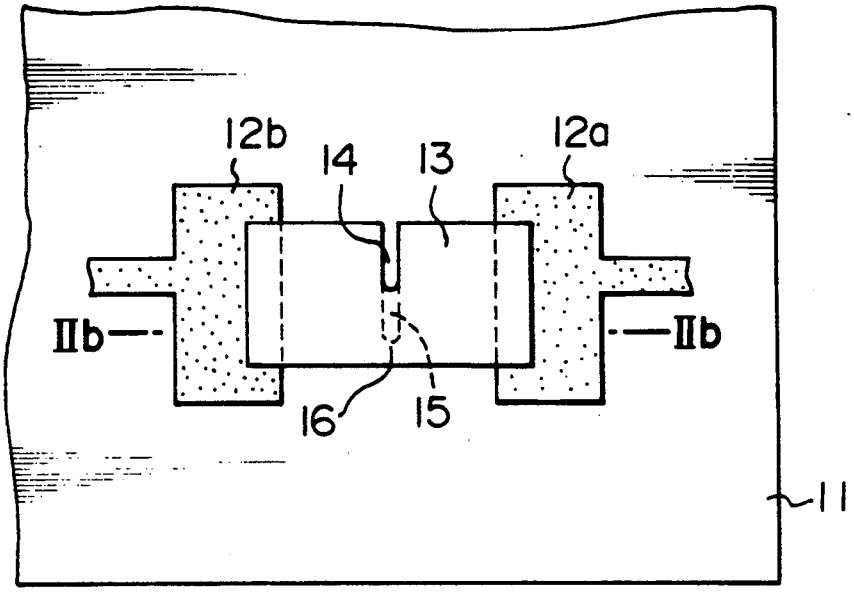
FIG. 2a PRIOR ART
FIG. 2*a* is a plan view of a conventional printed resistor circuit including a trimmed thick film-like resistance body in use.
Figure 2B:
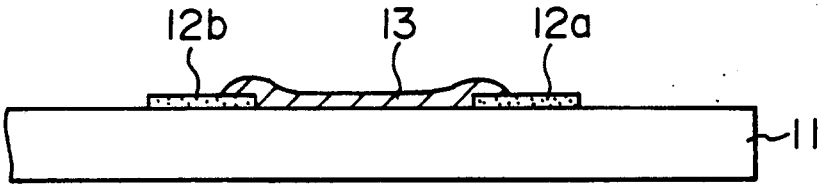
FIG. 2b PRIOR ART
FIG. 2*b* is a sectional view taken along the line II-*b*—II*b* of FIG. 2*a*.
Figure 3A:
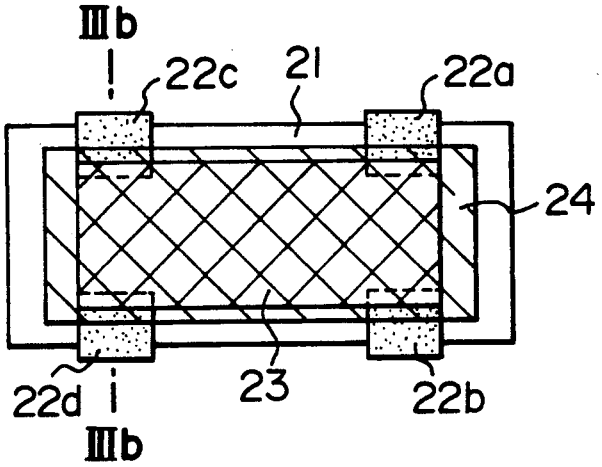
FIG. 3*a* is a plan view of a trimmed resistor of a thick film type according to a first embodiment of the present invention in use.
Figure 3B:
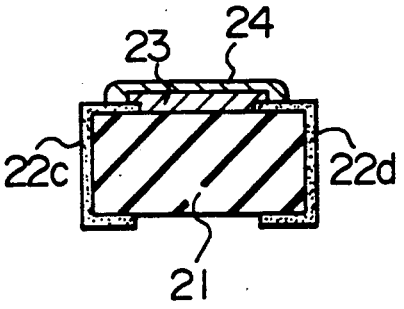
FIG. 3*b* is a sectional view taken along the line III-*b*—III*b* of FIG. 3*a*, FIGS. 4*a* and 4*b* are a plan view and a side view showing a first using method (i.e., method of adjusting a resistance value) of a trimmed resistor of a thick film type, respectively.

FIGS. 3*a* is a plan view of a trimmed resistor of a thick film type according to the first embodiment, and FIG. 3*b* is a sectional view taken along the line III-*b*–III*b* of FIG. 3*a*. In the FIGS. four external electrodes 22*a*, 22*b*, 22*c* and 22*d* are arranged at the both sides of a rectangular insulation base plate 21 in a point symmetrical manner, and a film-like resistance body 23 and the thick-film like resistance body 23 and a protecting film 24 are laid one upon another on a surface of the insulation base plate 21 surrounded by the electrodes 22a–22d. In general, the insulation base plate 21 is made from a conductive material of palladium-silver group, the thick film-like resistance body 23 from a resistive material of ruthenium oxide group and the protective film 24 from a glass having a low melting point.

Figure 4A:
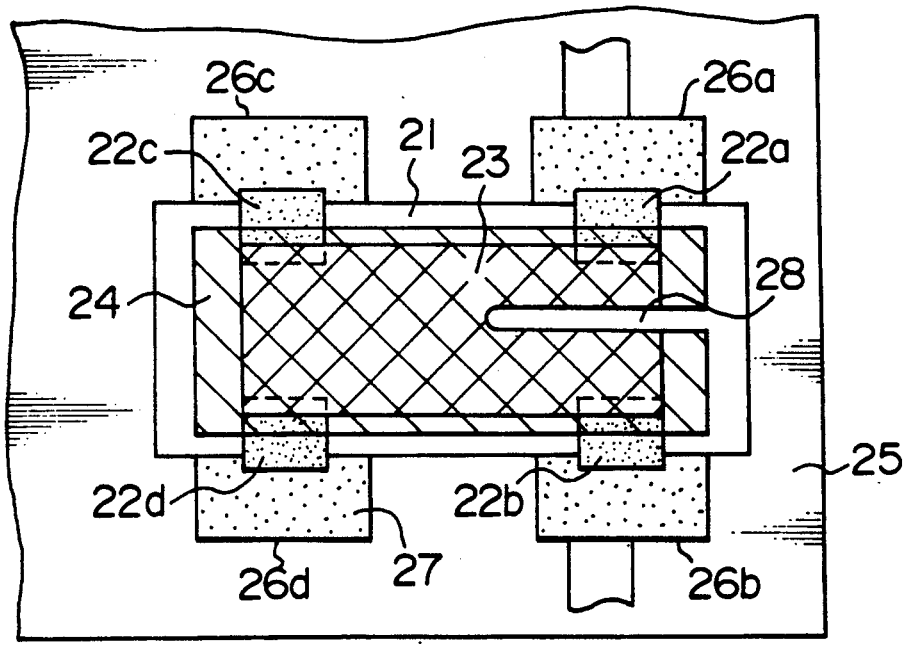
Figure 4B:
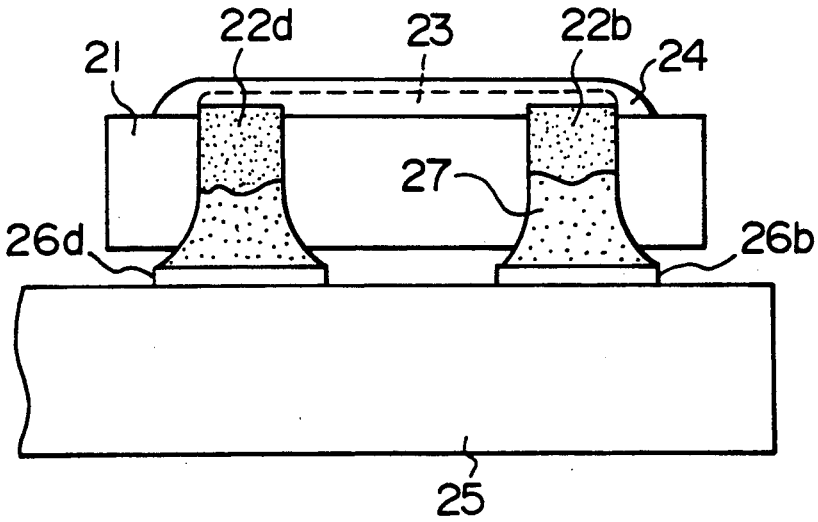

Referring to FIGS. 4a and 4b, a first using method, in other words, a fabricating and mounting method, of a thick film-like resistor of a trimming type constructed as mentioned above will be described below.

On a printed base plate 25 made from an usual material by means of an usual method, there are arranged soft soldering lands 26a and 26b respectively corresponding to external electrodes 22a and 22b formed at the right end portion of the resistor and soft soldering lands 26c and 26d for respectively fixing external electrodes 22c and 22d, these four soldering lands being located in a symmetrical manner. The electrodes 22a, 22b, 22c and 22d are connected with the soft soldering lands 26a, 26b, 26c and 26d, respectively by means of soft solder through an usual soft soldering method such as reflowing, soft solder dipping, and use of soft soldering tool.

The trimming for adjusting the resistance value is conducted by forming a cut slit 28 in the thick film-like resistance body 23 from a side of the external electrodes 22a and 22b connected with the resistor terminals by an usual method using such as a laser, a sand blast, and a cutter. The resistance value between the electrodes 22a and 22b serving as terminals of the resistor can be adjusted by varying the depth of the cut slit 28.

Figure 5:
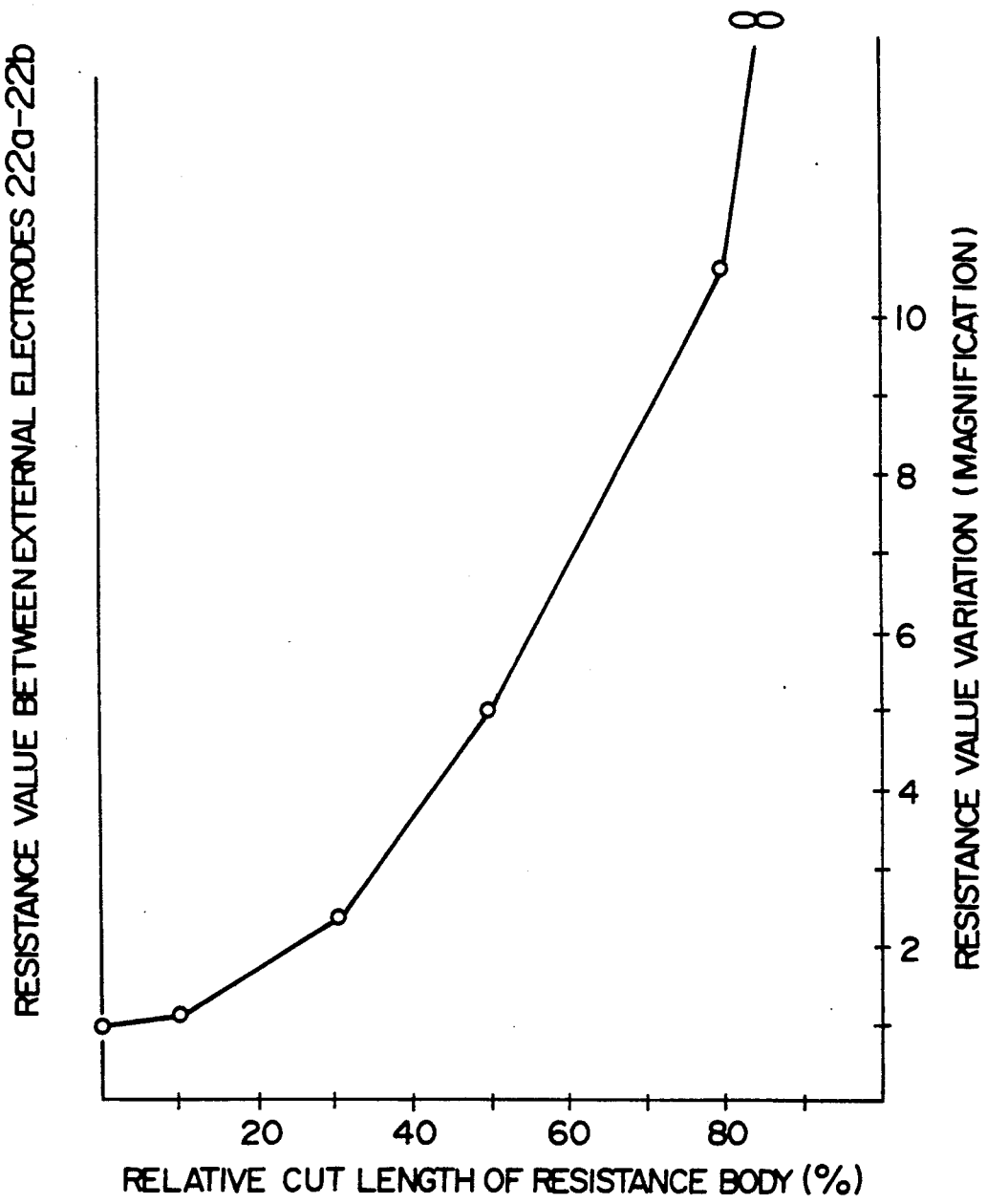
FIG. 5 shows a characteristic curve for the resistance value variation in case of the first using method.

FIG. 5 shows a characteristic curve indicating a relation between the resistance value between the external electrodes 22a and 22b and the depth of the cut slit 28. The resistance variation rate changes according to the shape and dimension of the thick film-like resistance body 23, and to the dimension and positions of the external electrodes 22a, 22b, 22c and 22d are so on. In general, the practically maximum rate 10 can be easily obtained. Further, since the soldering lands 26a, 26b, 26c and 26d mounted on the thick film-like resistor body and on the printed board have non-directional feature, the taping or the mounting work thereof can be treated in the same way as in usual tip resistor, and neither tip rising nor tip bending is caused during soft soldering. As a result, an effective self-alignment function can be obtained, and these lands can be located at correct positions by virtue of this self-alignment, thereby making it possible to form a cut slit in the resistor at a predetermined position with accuracy.

Figure 6:
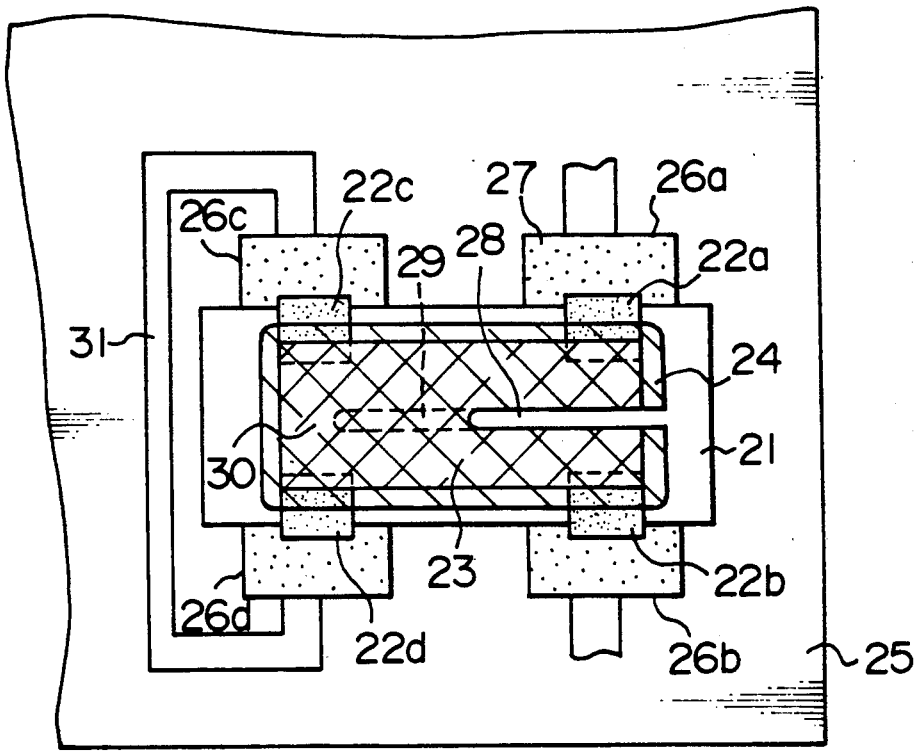
FIG. 6 is a plan view showing a second using method.

FIG. 6 is a plan view showing a second using method of this embodiment, where the soft soldering lands 26c and 26d are connected to each other with a wiring pattern 31 provided for by-passing. The cut slit 28 in the thick film-like resistance body 23 is formed in the same manner as in the first using method shown in FIG. 4.

Figure 7:
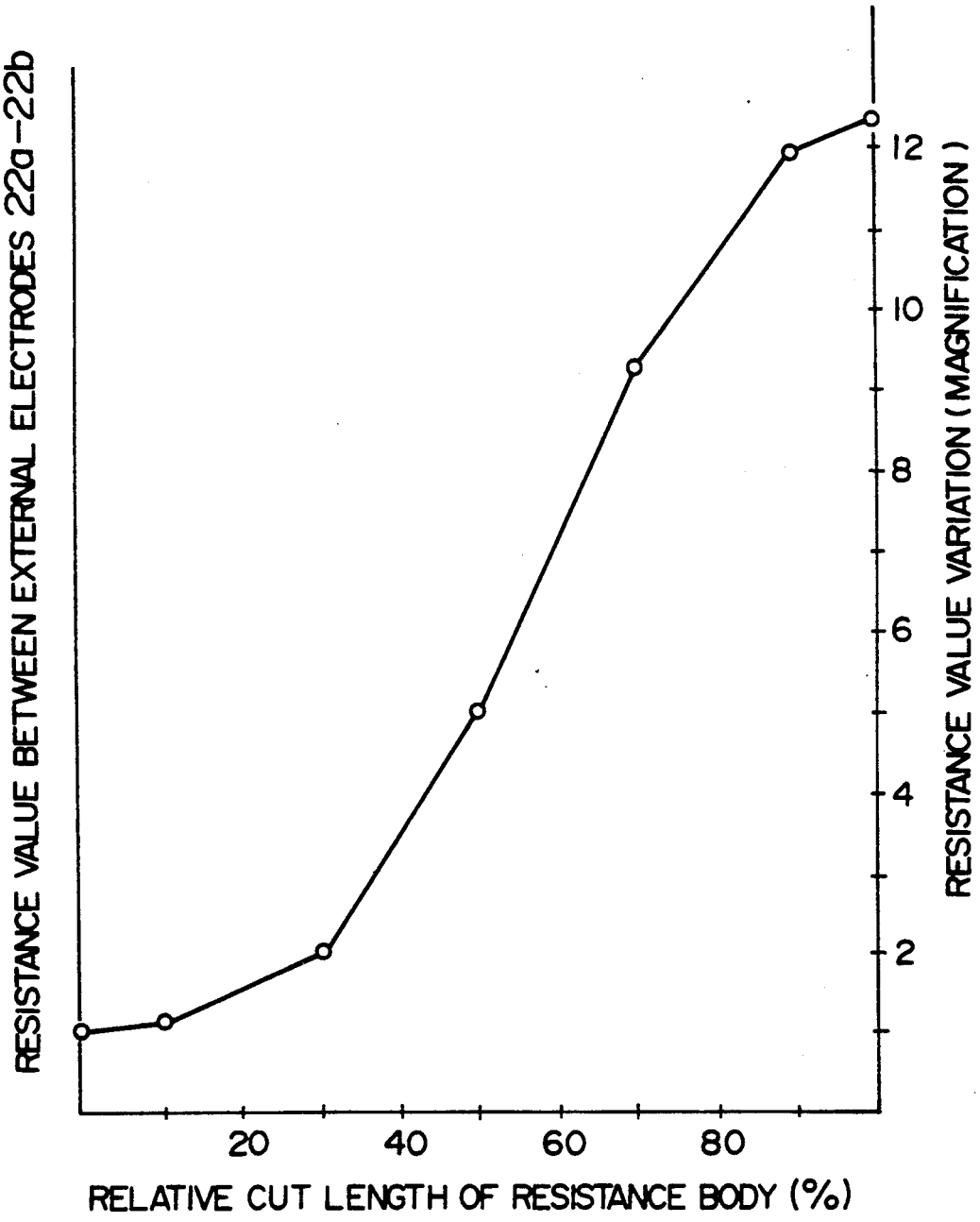
FIG. 7 shows a characteristic curve of the resistance value variation in case of the second using method.

FIG. 7 shows a characteristic curve of the resistance value variation in case of this using method. In this using method, there can be obtained an advantage, in addition to that obtained in the first using method, that no electric current concentration or no power, capacity fall is caused even when the cut slit 29 is made deeper so that the remaining portion 30 become narrower as shown with a broken line and the resistance value become greater, because, in such a case, the electric current flows more through the wiring pattern 31, which has a lower resistance value, than through the remained portion 30. As a result, it becomes possible to form the cut slit 28 with a great depth such that a wider range of the resistance value variation can be obtained.

Further, even in case the thick film-like resistance body 23 is cut off by accident, the resistance value between the external electrodes 22a and 22b does not become infinitely great, but a certain electric flow can be remained, thereby preventing any break-down of the other parts or any abnormal operation of the resistor.

Figure 8:
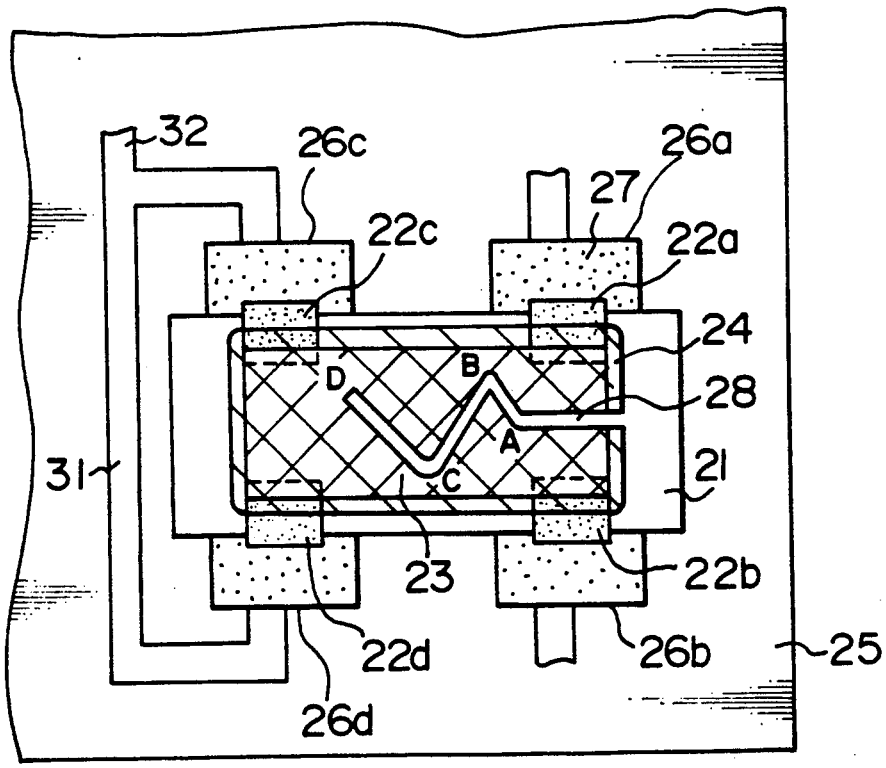
FIG. 8 is a plan view showing a third using method.

Next, referring to FIG. 8, a third using method will be described below. The third method differs from the second method shown in FIG. 6 in that the third using method includes another wiring pattern 32 connected with the by-pass wiring pattern 31 for providing an intermediate terminal to be connected with another electric part (not shown), and the cut slit 28 is made to have a wave shape having turning points A, B, C and D.

Figure 9:
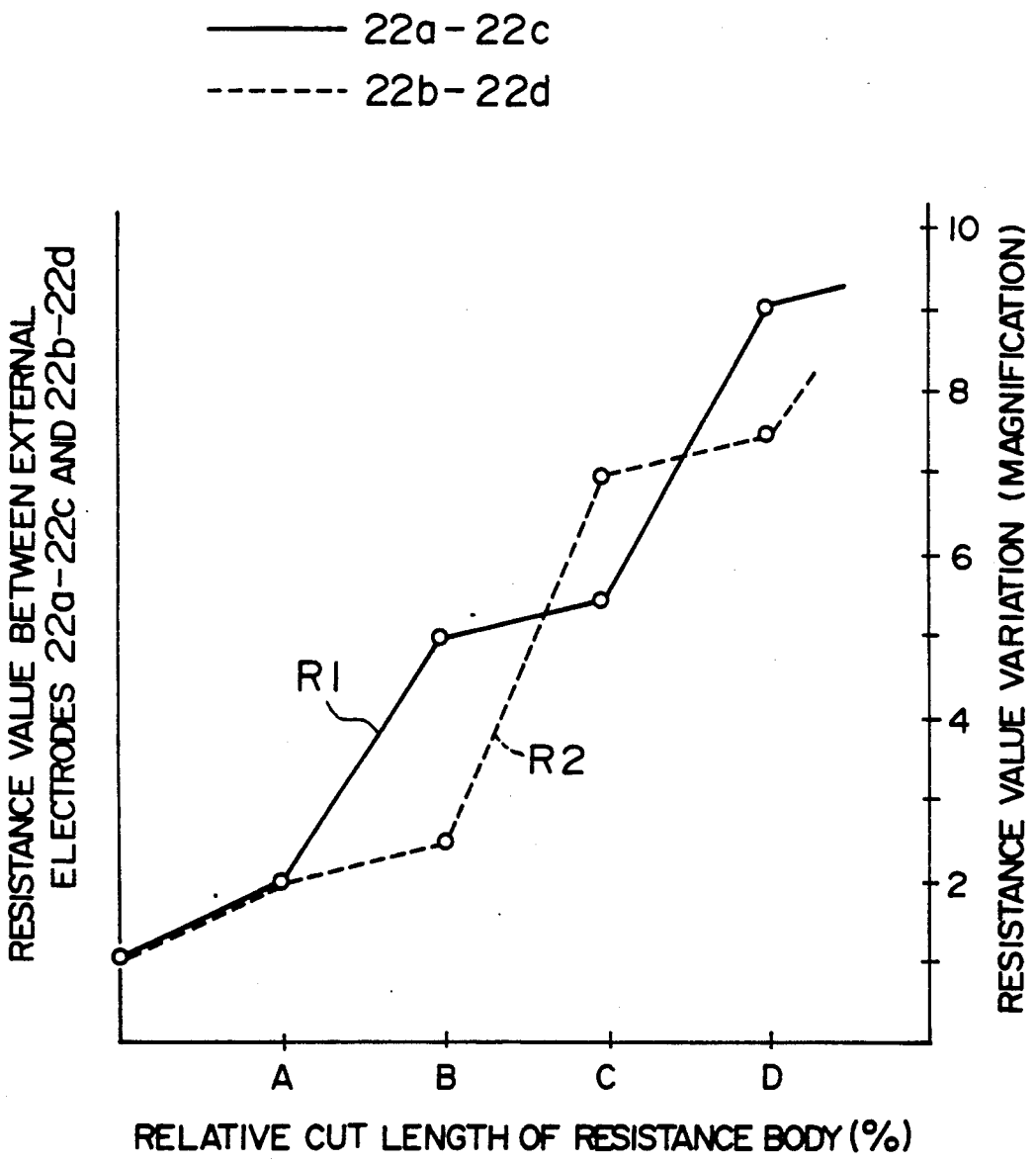
FIG. 9 shows a characteristic curve of the resistance value variation in case of the third using method.
Figure 10:
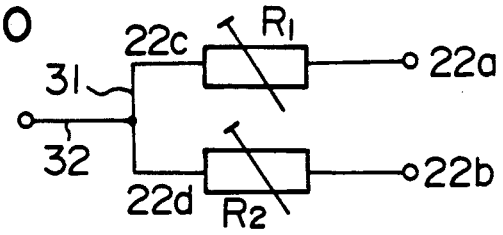
FIG. 10 shows an equivalent circuit in case of the third using method.

FIG. 9 shows characteristic curves of the resistance value variation indicating the variations of a resistance value R1 between the external electrodes 22a and 22c and of a resistance value R2 between the external electrode 22b and 22d, and FIG. 10 shows an equivalent circuit thereof. By making the shape of the cut slit 8 not straight, but wave-like, in other words, by making the cut slit turn right and then turn left relative to the center line, the resistance values can be controlled so as to obtain various resistance value relations such as $R1=R2$, $R1>R2$, or $R1>R2$. Therefore, this using method has an advantage, in addition to those obtained in the first and the second using methods shown in FIGS. 4 and 6, respectively, that there can be constituted a circuit in which the potential equilibrium between the external electrodes 22a and 22b can be adjusted.

Figure 11A:
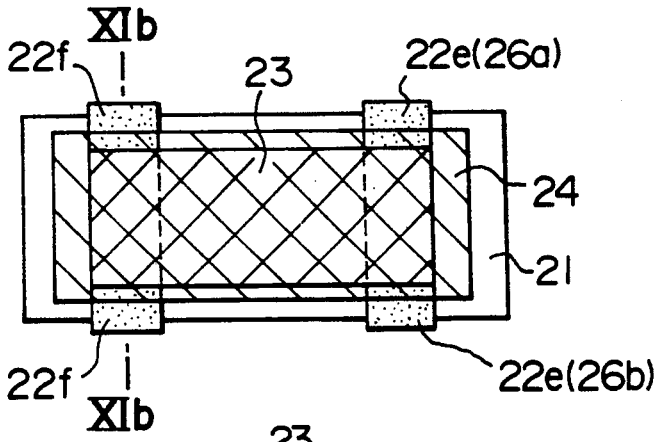
FIG. 11*a* is a plan view of a trimmed resistor of a thick film/type according to a second embodiment of the present invention in use.
Figure 11B:
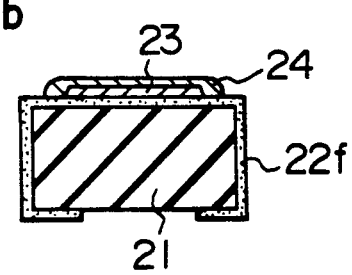
FIG. 11*b* is a sectional view taken along the line XI*b*—XI*b* of FIG. 11*a*.

FIG. 11a is a plan view of a trimmed resistor of a thick film type according to a second embodiment, and FIG. 11b is a sectional view taken along the line XI*b*—XI*b* of FIG. 11a. This embodiment differs from the first embodiment shown in FIG. 3 in that the four external electrodes 22a, 22b and 22c, 22d in the first embodiment are united into two external electrodes 22e and 22f by combining two of the four electrodes with each other on the upper surface of the insulation base plate 21.

Figure 12:
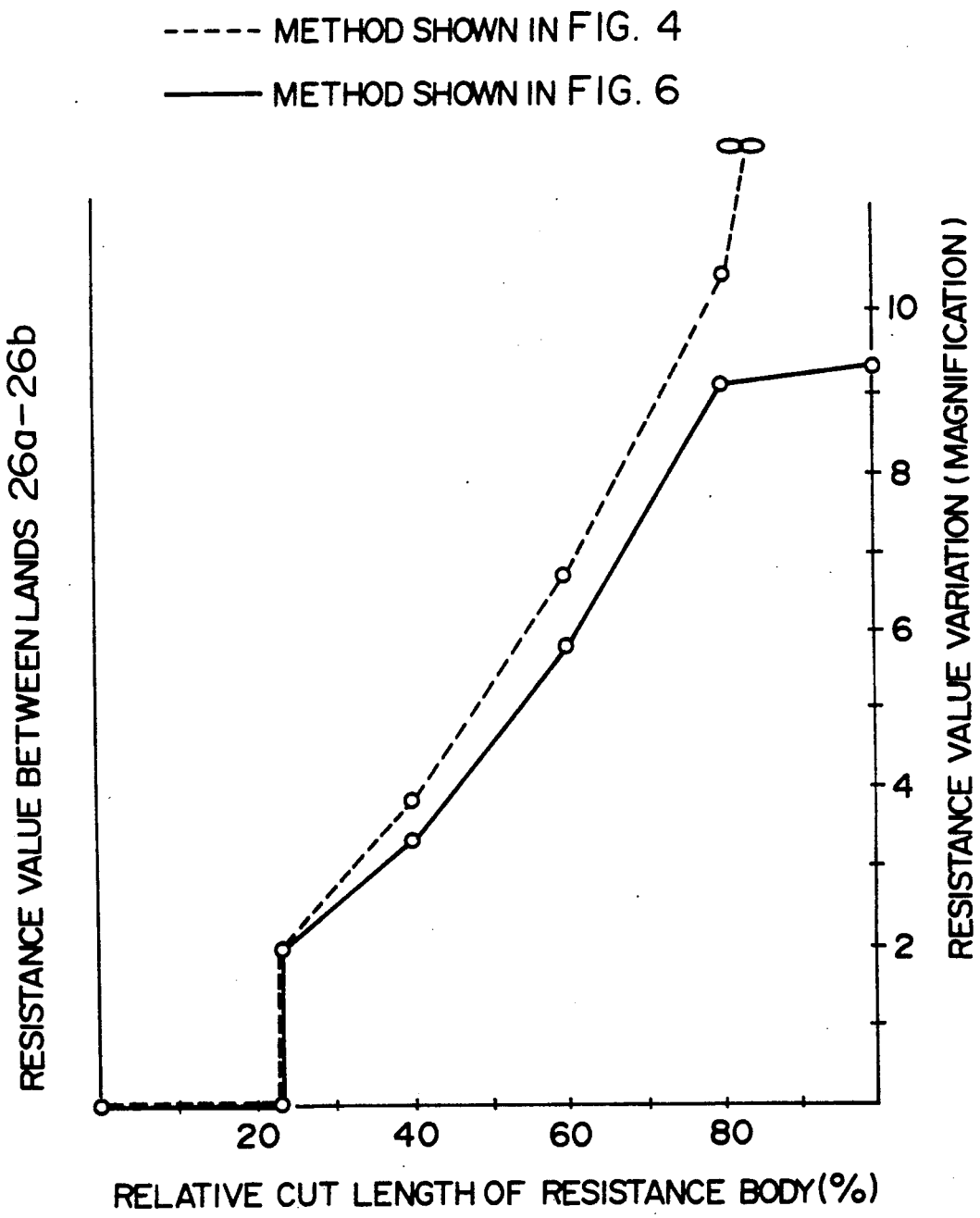
FIG. 12 shows characteristic curves of the resistance value variations in case of first and second using method applied to a trimmed resistor of a thick film type according to the second embodiment.

FIG. 12 shows characteristic curves of the resistance value variations in case of the first and second using method applied to the second embodiment of the resistor. The cut slit (not shown) is the same as in the first and second using method shown in FIGS. 4 and 6, respectively, but the resistance value remains zero until the relative length of the cut slit reaches 20% where the external electrode 22e is cut off, and rapidly increased after the cut off of the external electrode 22e in similar manners shown in FIGS. 5 and 7. This second embodiment has an advantage that the manufacturing of a resistor is easier than that in the first embodiment shown in FIG. 3.

Figure 13A:
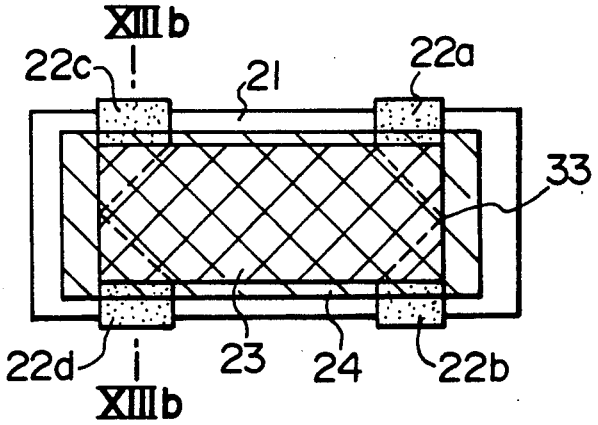
FIG. 13*a* is a plan view of a trimmed resistor of a thick film type according to a third embodiment of the present invention.
Figure 13B:
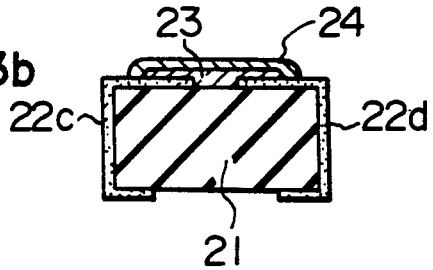
FIG. 13*b* is a sectional view taken along the line XIII*b*—XIII*b* of FIG. 13*a*.
Figure 14:
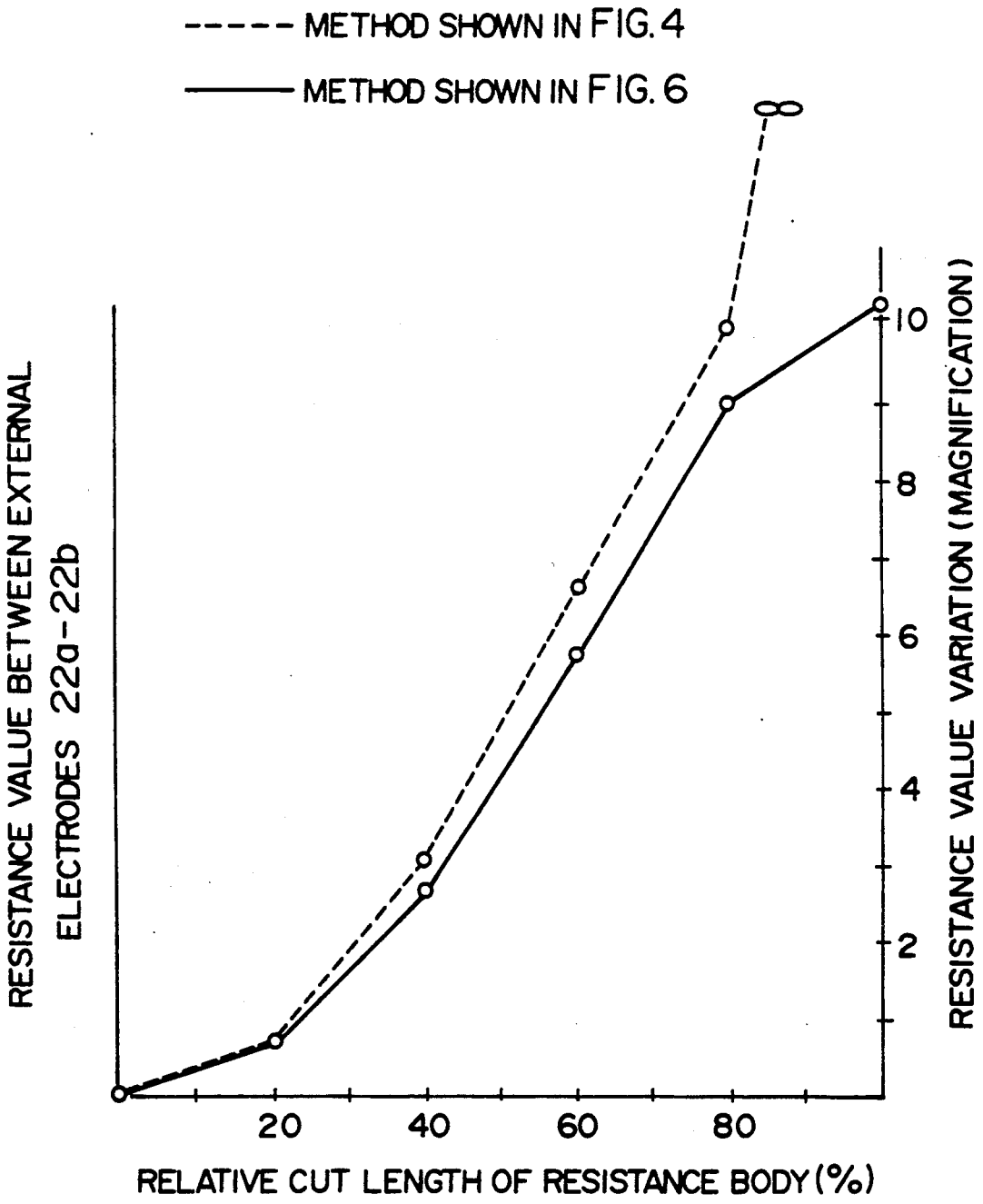
FIG. 14 shows characteristic curves of the resistance value variations in case of first and second using method applied to a trimmed resistor of a thick to the third embodiment.

FIG. 13a is a plan view of a trimmed resistor of a thick film type according to a third embodiment, and FIG. 13b is a sectional view taken along the line XIII*b*—XIII*b* of FIG. 13a. This embodiment differs from the first embodiment in that the external electrodes 22a and 22b opposite to each other include extending portions each having a triangular shape and contacting with each other at their tip contact point 33, and the external electrodes 22c and 22d are shaped in the same way. FIG. 14 shows characteristic curves of the resistance value variations between the external electrodes 22a and 22b, when a cut slit 8 is formed by means of the fist and second using methods shown in FIGS. 4 and 6, respectively. In this case, the cut slit 8 is cut as starting at the contact point 33. Therefore, the resistance value remains zero before the cutting, because the external electrodes 22*a* and 22*b* are point-contacted with each other before the cutting, and starts increasing just when the contact point 33 is cut and increases smoothly under the function of the external electrodes each having a triangular shape. When the cut slit becomes more deeper, the resistance value increases as having the same tendencies as those shown in FIGS. 5 and 7. In this embodiment, there is obtained an advantage, in addition to that in the first embodiment, that the resistance value can be continuously increased from zero value, and, in particular, a characteristic quality of the resistance value like those of conventional variable resistors can be obtained. Further, the resistors according to the first and third embodiments can be used, of course, by applying the third using method.

Although the thick film-like resistors of trimming type according to the above-mentioned three embodiments are of a tip type, resistors of thin film type, polymer type, or resin base board type can have the same effects. Further, resistors other than a tip shape type, for example, resistor having lead wires can have the same effects only excluding with respect to matters relating a reflow soldering.

Figure 15A:
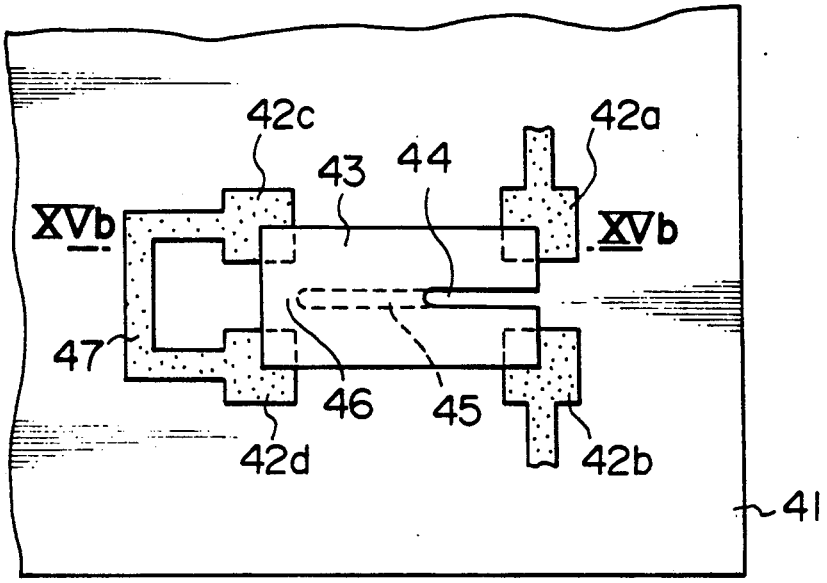
FIG. 15*a* is a plan view of a printed resistance circuit of a trimming type according to a fourth embodiment.
Figure 15B:
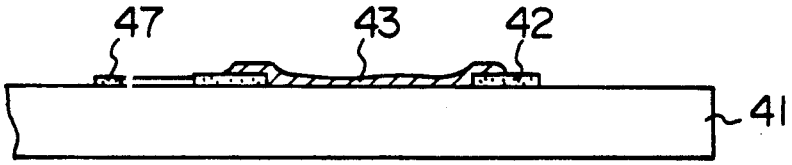
FIG. 15*b* is a sectional view taken along the line XV*b*—XV*b* of FIG. 15*a*.

FIG. 15*a* is a plan view of a printed resistance circuit of a trimming type according to a fourth embodiment and FIG. 15*b* is a sectional view taken along the line XV*b*—XV*b* of FIG. 15*a*.

In FIGS. 15*a* and 15*b*, the insulation base plate 41 is mainly made from alumina or the like, and two electrodes 42*a* and 42*b* serving as the resistor terminals are formed on a surface of the plate 41 along the right side thereof by printing and baking a material of palladium-silver group, while electrodes 42*c* and 42*d* for by-passing are formed along the left side of the plate 41 and connected with each other through a conductive wire 47. Further, a thick film-like resistance body 43 is formed so as to connect the above-mentioned electrodes 42*a*, 42*b*, 42*c* and 42*d* with one another by printing and baking a material of ruthenium oxide group. A cut slit 44 for trimming is formed in the thick film-like resistance body 43 as starting from the side of the electrodes 42*a* and 42*b*, which serve as resistor terminals, by using an usual means such as laser, sand blast, and cutter.

Figure 16:
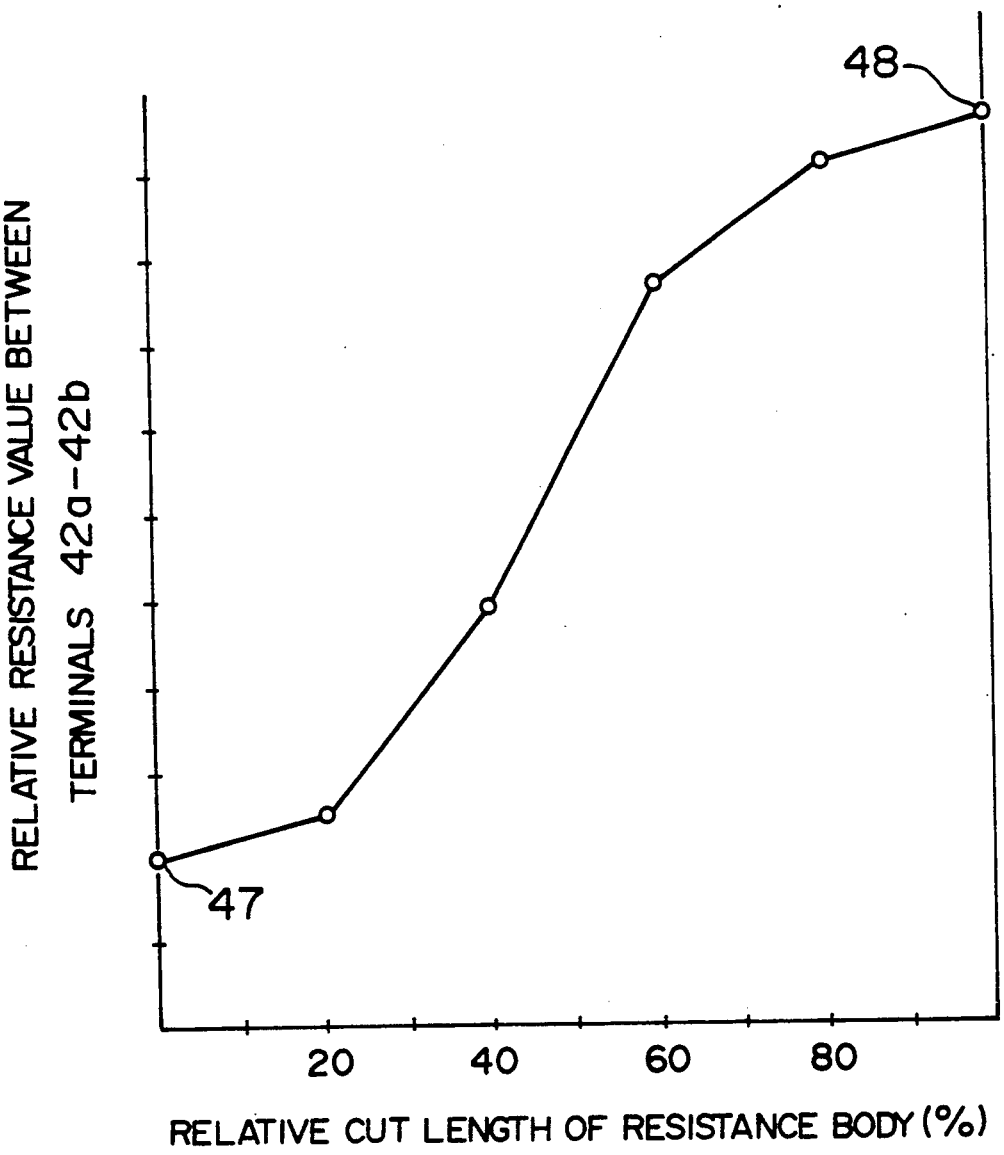
FIG. 16 shows a characteristic curve of the resistance value variations due to a trimming according to the fourth embodiment.

FIG. 16 shows a characteristic curve of the resistance value variation between the electrodes 42*a* and 42*b* due to trimming.

In this embodiment, when the cut slit 45 is deep as shown with a broken line and the resistance value of the remained portion 46 is great, the electric current flows mainly through the conductive wire 47. As a result, there is caused neither electric current concentration at the remained portion 46 nor electric capacity fall of the resistor. In consequence, it becomes possible to cut the slit deep so that a wide range of the resistance value variation can be obtained. Further, even when the thick film-like resistor body 43 is completely cut, the resistance value does not become infinitely great, because the electrodes are connected with each other through the conductive wire 47, but indicates a final resistance value 48, which is determined by several factors relating to the thick film-like resistance body 43 and the cut slit 44.

Figure 17:
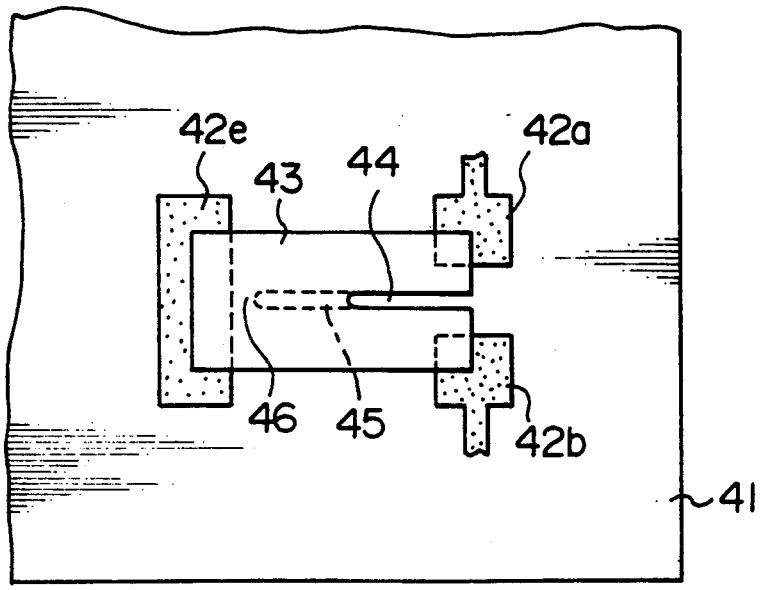
FIG. 17 is a plan view of a printed resistance circuit of a trimming type according to a fifth embodiment.

FIG. 17 is a plan view of a printed resistance circuit of a trimming type according to a fifth embodiment. This fifth embodiment differs from the fourth embodiment shown in FIG. 15 in that a large electrode 42*e* is provided instead of the left side electrodes 42*a* and 42*d* for by-passing, the electrode 42*e* achieving the functions of electrodes 42*c*, 42*d* and of the conductive wire 47 shown in FIG. 15. Since, with respect to the other features, this fifth embodiment is the same as the fourth embodiment, the same constituting members are indicated with the same reference numerals, and descriptions therefor are omitted. The characteristic of the resistance value variation due to the trimming according to this embodiment is similar to that shown in FIG. 16, because the large electrode 42*e* has the same function as that of the conductive wire 47 of the fourth embodiment shown in FIG. 15. With respect to other features, the same effects can be obtained, and, in addition, the electrodes can be formed more easily than in the fourth embodiment.

Figure 18A:
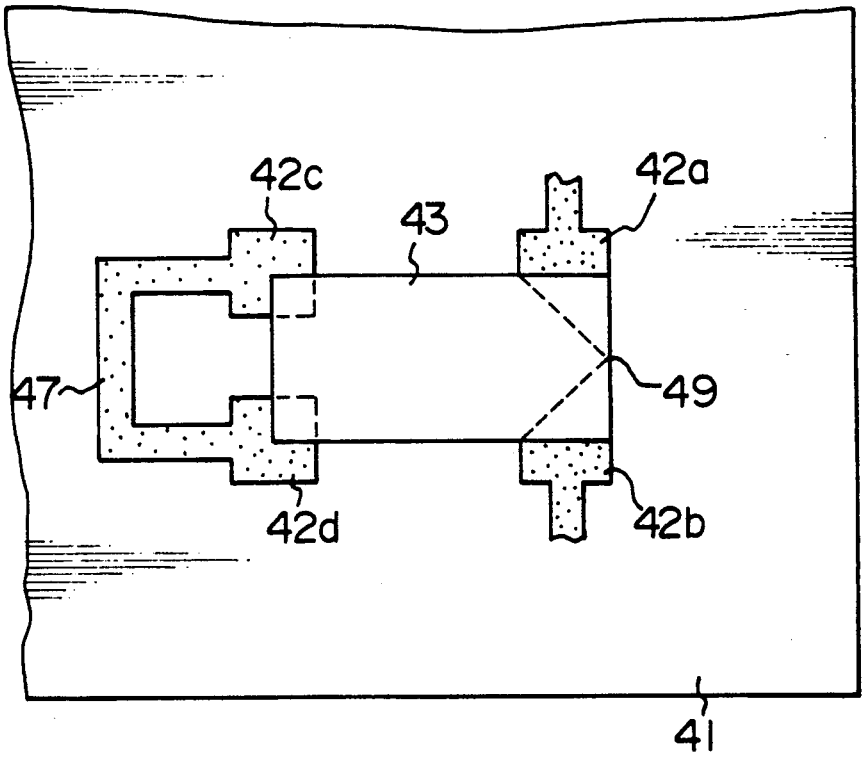
FIGS. 18*a* and 18*b* are plan views of a printed resistance circuit of a trimming type according to a sixth embodiment before and after trimming, respectively.
Figure 18B:
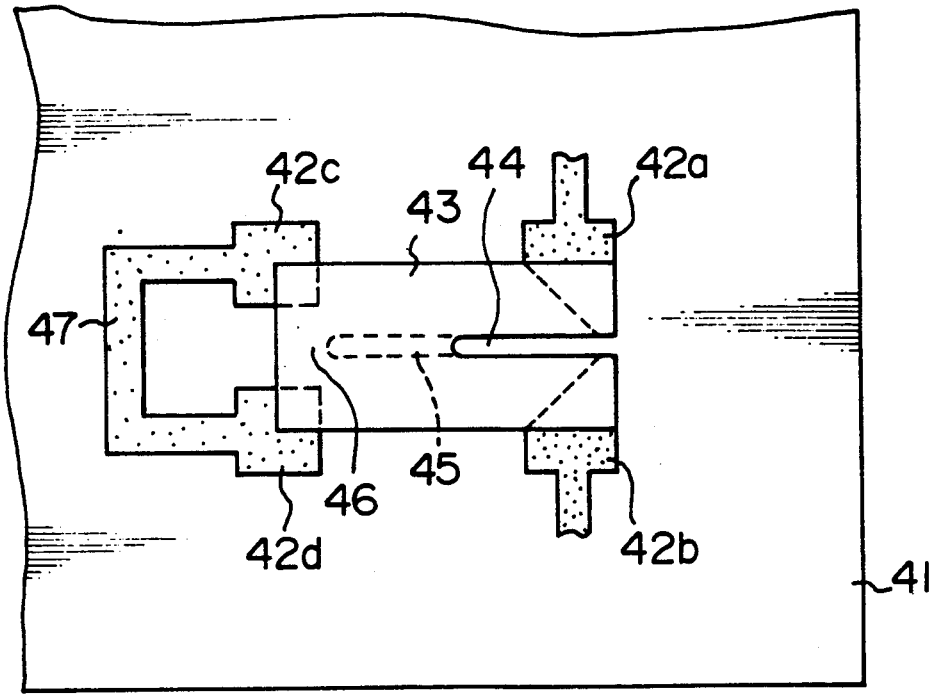

FIGS. 18*a* and 18*b* are plan views of a printed resistance circuit of a trimming type according to a sixth embodiment of the present invention before trimming and after trimming, respectively..

Referring to FIG. 18*a*, this embodiment differs from the fourth embodiment shown in FIG. 15 in that each of the electrodes 42*a* and 42*b* serving as resistor terminals has a triangular portion lying on the thick film-like resistance body 43, and the right sides of the triangular portions of the electrodes 42*a* and 42*b*, whose apexes are brought into contact with each other at a contact point 49, are disposed so as to be coincident with the right side of the thick film-like resistance body 43. Since, with respect to other features, this sixth embodiment is the same as the fourth embodiment, the same constituting members are indicated with the same reference numerals, and descriptions therefor are omitted.

Figure 19:
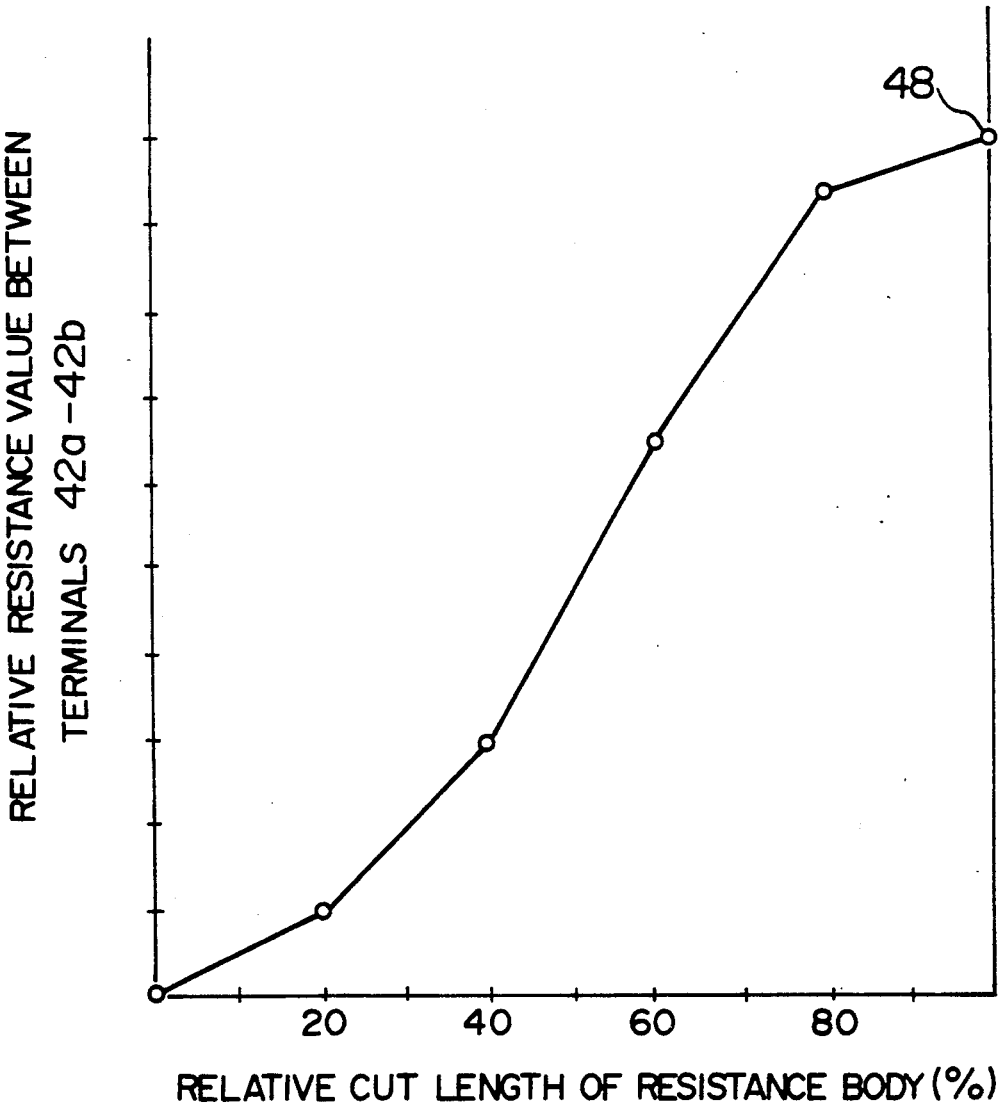
FIG. 19 shows a characteristic curve of the resistance value variations in case of the sixth embodiment.

Referring to FIGS. 18*a* and 18*b*, the cut slit 44 is cut as starting from the contact point 49 locating at the middle of the right side of the thick film-like resistance body 43. FIG. 19 shows a characteristic curve of the resistance value variations obtained when such a trimming is carried out.

Since the electrodes 42*a* and 42*b* are in contact with each other at the contact point 49, the resistance value is zero before trimming, and starts to increase just after the cutting of the contact point 49. Further, since the tip portions of the electrodes 42*a* and 42*b* are triangular, the resistance value increases linearly, and then increases with the same tendency as that shown in FIG. 16 and finally reaches a final resistance value 48. Since the resistance value can be continuously changed from zero to the final value 48, this embodiment has an effect, in addition to the effect obtained in the fourth embodiment, that there is obtained a characteristic of the resistance value variation similar to that of a conventional variable resistor. Further, if, in the fifth embodiment shown in FIG. 17, the two right side electrodes serving as resistor terminals are constructed with the same structure as in this embodiment, the same characteristic as shown in FIG. 19 can be obviously obtained.

Figure 20:
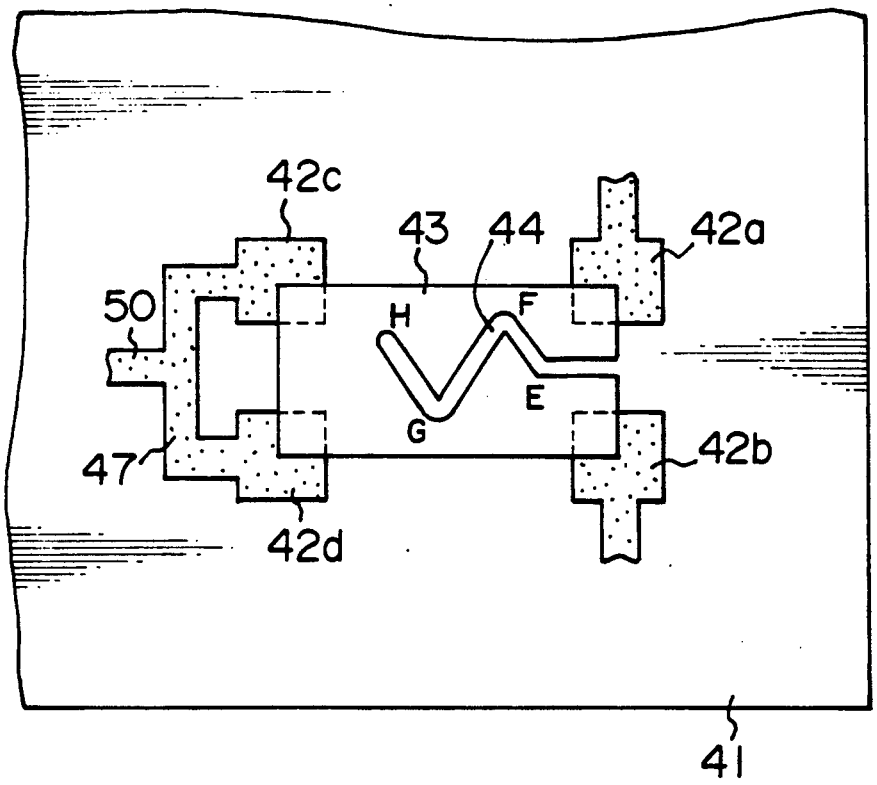
FIG. 20 is a plan view of a printed resistance circuit of a trimming type according to a seventh embodiment.

FIG. 20 is a plan view of a printed thick film like resistance circuit of a trimming type according to the seventh embodiment. This embodiment differs from the fourth embodiment shown in FIG. 15 in that the conductive wire 47 is connected with a wiring pattern 50 for utilizing the electrodes 42*c* and 42*d* as an intermediate terminal, and the cut slit 44 is formed so as to have a wave-like shape having turning points E, F, G and H. Since, with respect other features, this seventh embodiment is the same as the fourth embodiment, the same constituting members are indicated with the same reference numerals, and descriptions therefor are omitted.

Figure 22:
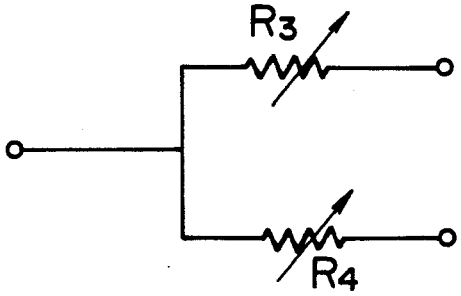
FIG. 22 shows an equivalent circuit of the seventh embodiment.
Figure 21:
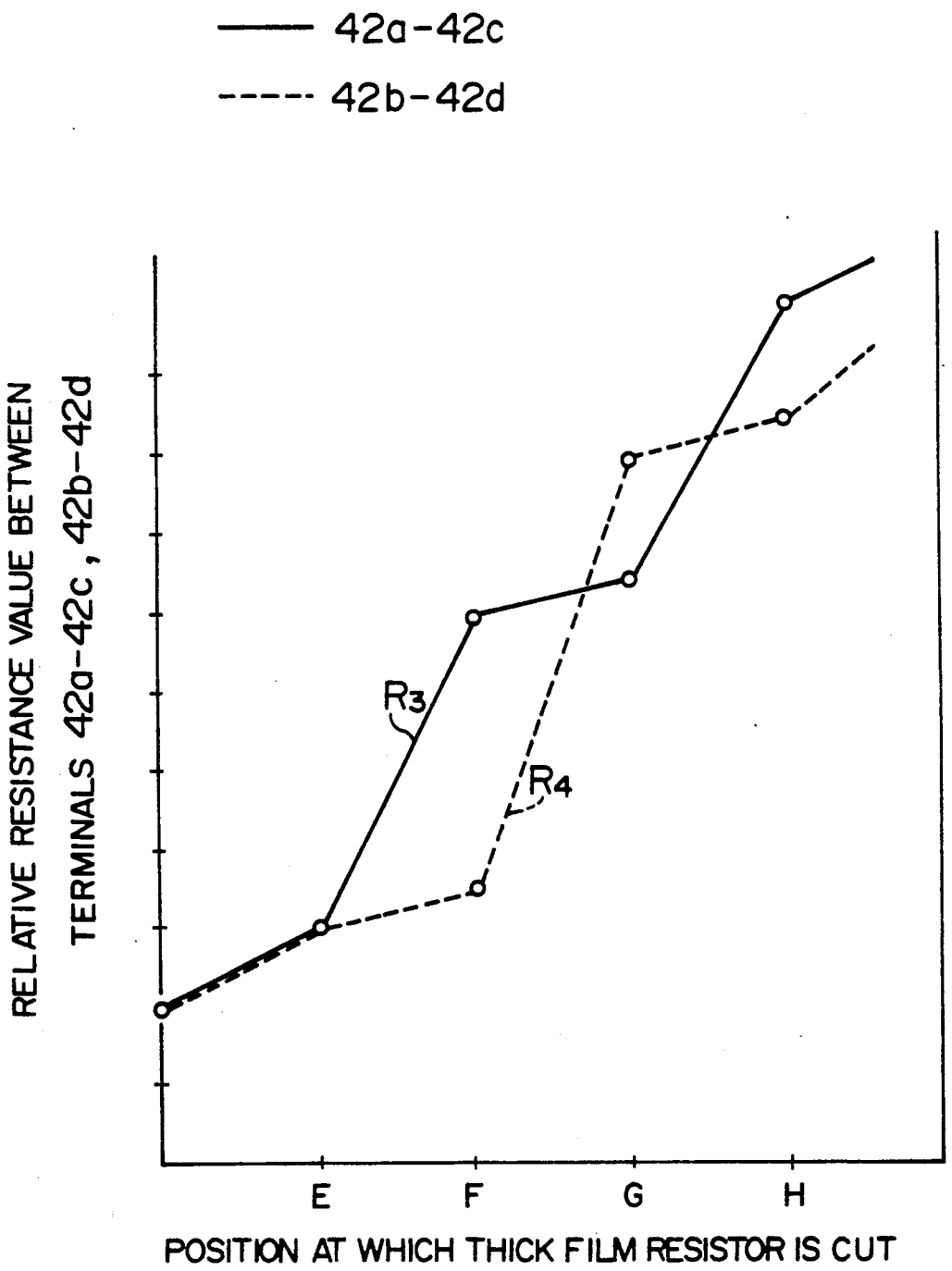
FIG. 21 shows a characteristic curve of the resistance value variations in case of the seventh embodiment.

FIG. 21 shows a characteristic curve of the resistance value variation of a thick film like resistor of a trimming type constructed as mentioned above. With respect to relations among the positions of the turning points E, F, G and H, the resistance value (R3) between the electrodes 42*a* and 42*c*, and the resistance value (R4) between the electrodes 42*b* and 42*d*, the resistance value varies so that R3=R4 when the cut slit is parallel to the center line, R3>R4 when the cut slit runs towards the electrode 42*a* side, and R3<R4 when the same runs towards the electrode 42*b* side. In consequence, according to this embodiment, an advantage that the equilibrium relation between the electrodes 42*a* and 42*b* can be arbitrarily adjusted is obtained in addition to that obtained in the fourth embodiment. FIG. 22 shows an equivalent circuit of the seventh embodiment.

Further, if the large electrode 42*e* locating on the left side in the fifth embodiment shown in FIG. 17 or the conductive wire 47 in FIG. 18 is used as an intermediate terminal of the resistor and the cut slit 44 having a wave-like shape is utilized, the same effect as in the seventh embodiment can be obtained.

Although, in the above-mentioned embodiments 4 to 7, the resistor is constituted by a thick film-like resistance body 43, it can be also constituted by a resistance body of thin film type, polymer type, or printed circuit board type, and the same effect can be obtained in the latter cases.

Figure 23:
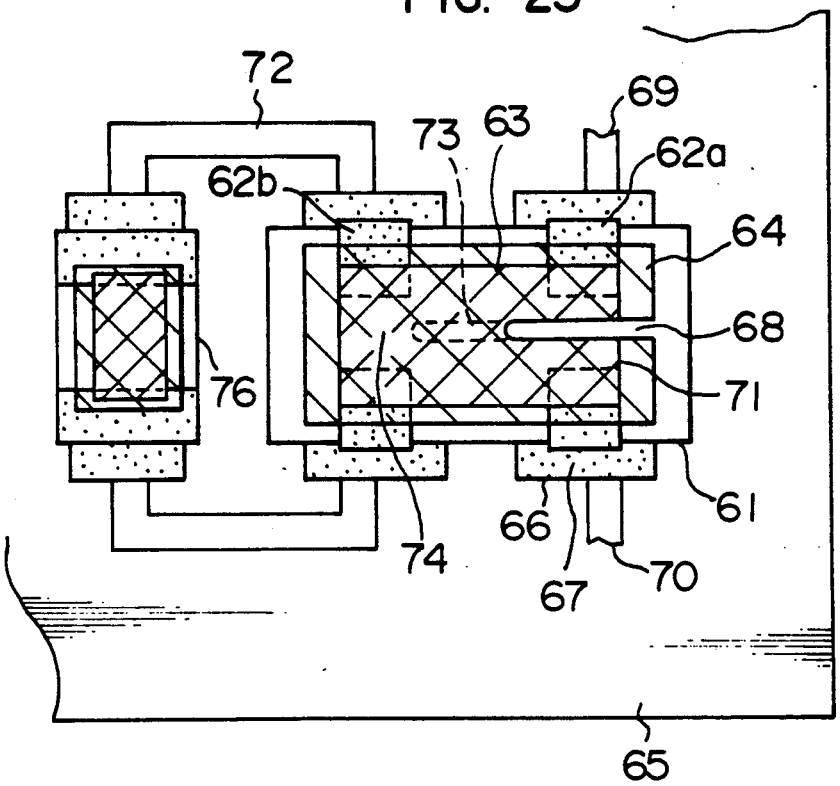
FIG. 23 is a plan view of a trimmed resistor of a thick film type according to an eighth embodiment.

FIG. 23 shows an eighth embodiment. The resistor shown in FIG. 23 is of a thick film-like trimming type, and comprises an insulation base plate 61 mainly made from alumina, first and second pair of external electrodes 62*a* and 62*b* made from a material of palladium-silver group, and a thick film-like resistance body 63 made from a material of ruthenium oxide and connected with all of the two pairs of the external electrodes 62*a* and 62*b*. Further, there are shown a protective film 64 made from a resin having a low melting point, a printed base board 65 made by using an usual material through an usual method, and two pairs of soft soldering lands 66 formed on the printed base board 65 at positions corresponding to the two pairs of the external electrodes 62*a* and 62*b*, respectively. A pair of soft soldering lands 66 among the two pairs of soft soldering lands 66 are connected with each other through a wiring pattern 72 and a by-pass resistance body 76. Numeral 68 denotes a cut slit cut in the film-like resistance body 63, which is trimmed by use of an usual method such as a laser, a sand blast, and a cutter. This cut slit 68 is successively trimmed as extending from the substantially middle portion of one side 71 of the film-like resistance body 63 interposed between the first pair of the external electrodes 62*a* towards the substantially middle portion of the opposite side, thereby adjusting the resistance value between the resistor terminals 69 and 70.

Figure 24:
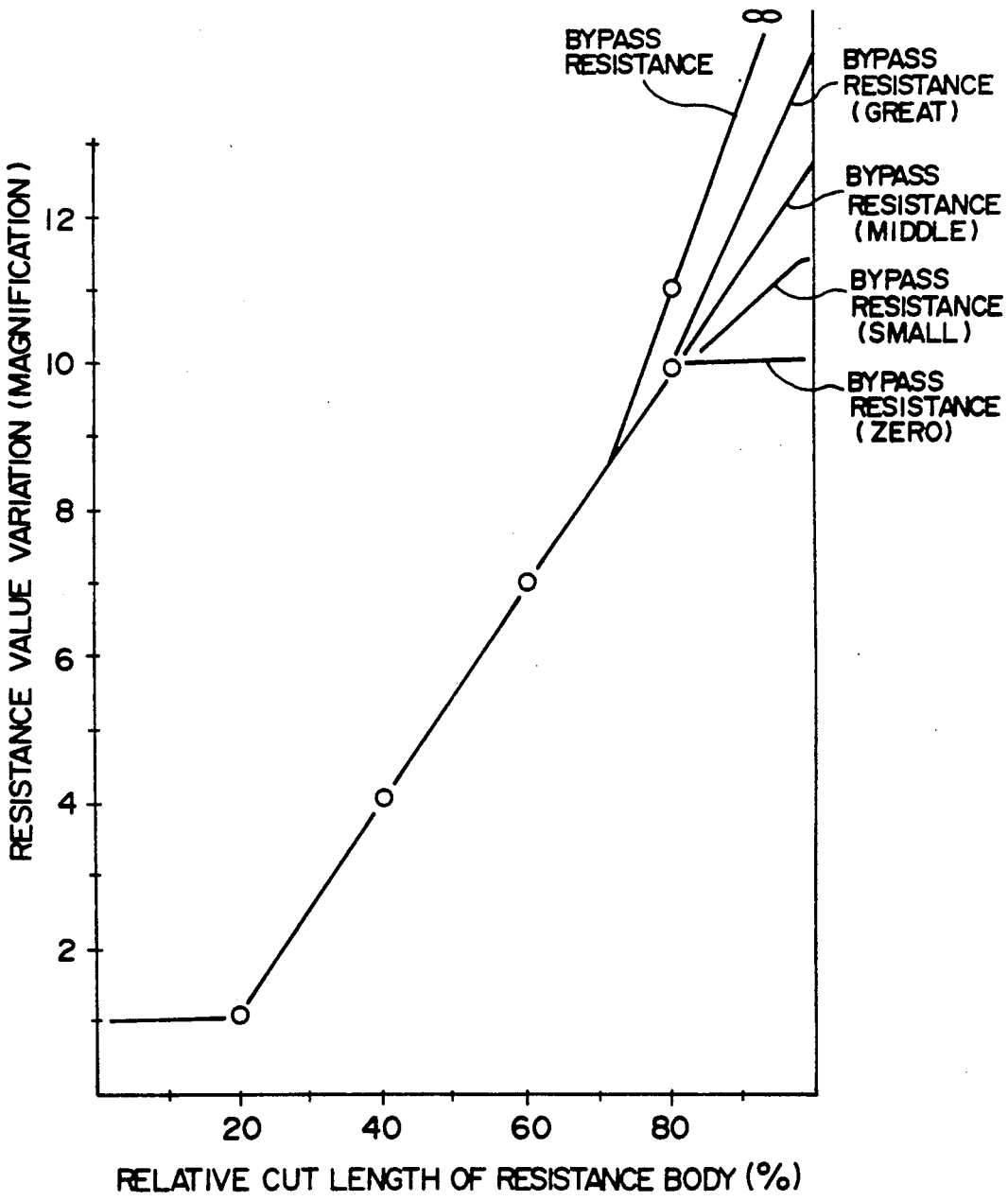
FIG. 24 shows characteristic curves of the resistance value variations in case of the eighth embodiment.

FIG. 24 shows changes of the resistance value due to the slit cutting according to this embodiment. When a portion of the film-like resistance body 63 locating between the second pair of electrodes 62*b*, which are not connected with the resistor terminals 69, 70, is trimmed deeper as shown in FIG. 23 with a broken line, and the remained portion 74 becomes narrower, the resistance value of the remained portion increases rapidly. If the resistance value of the by-pass resistance body 76 is assumed to be infinitely great, the resistance value between the resistor terminals 69 and 70, which is a resultant of the resistance values of the film-like resistance body 63 and the by-pass resistance body 76, increases rapidly. Further, in case the resistance value of the by-pass resistance body 76 is assumed to be zero, the most portion of the electric current flows through the by-pass resistance body 76, whereby the resistance value between the resistor terminals 69 and 70 is excessively suppressed by the by-pass resistance body 76 with a very narrow variation range. On the other hand, when a suitable resistance value (in FIG. 24, great, middle, and small resistance values are indicated.) of the by-pass resistance body 76 is selected, the electric current between the resistor terminals 69 and 70 are appropriately divided into two flows, one through the film-like resistance body 63 and the other through the by-pass resistance body 76. In this case, when the trimming in the film-like resistance body 63 become deeper, the resistance value of the film-like resistance body 63 increases, and as a result, the electric current flows mainly through the by-pass resistance body 76. In consequence, the resultant of the resistance values of the film-like resistance body 63 and the by-pass resistance body 76 is suppressed by the by-pass resistance body 76, and the electric current does not increase rapidly, but gradually. Thus, even when the film-like resistance body is cut as forming a slit near between the paired external electrodes 62*b*, the resultant of the resistance values continues to increase gradually. As a result, the resistance value can be varied in a wide range; the slit can be trimmed in a wide region; and the resistance value can be determined with a good accuracy. Further, any electric current concentration, which may deteriorate the stability of the resistance value during a long time and decrease the electric power capacity, is prevented, and even when the film-like resistance body is completely cut off by accident, the resistance value does not become infinitely great. Accordingly, the area where the trimming can be practically carried out near the second paired external electrodes 62*b* is enlarged.

Figure 25:
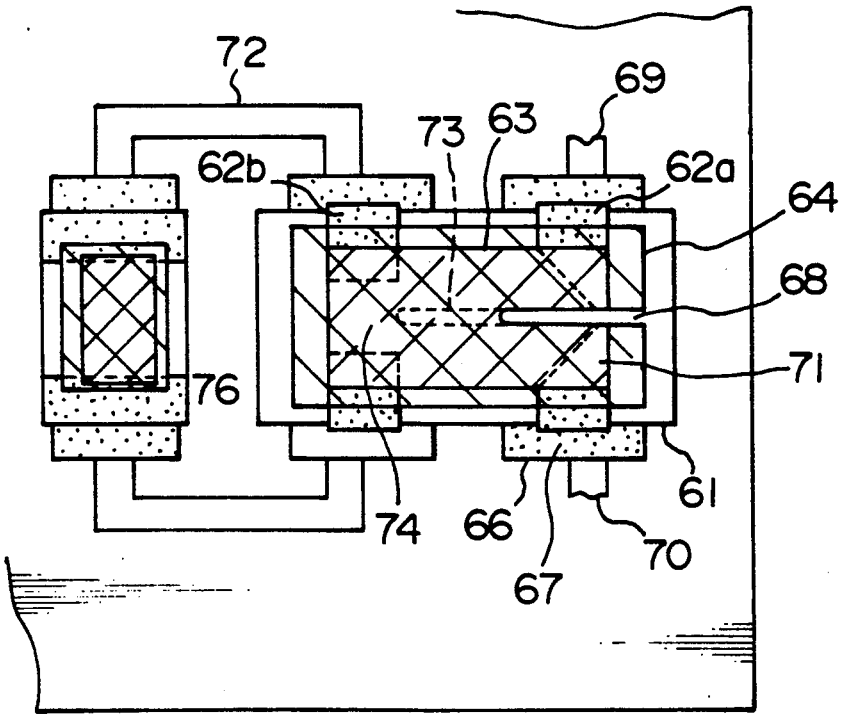
FIG. 25 is a plan view of a trimmed resistor of a thick film type according to a ninth embodiment.

FIG. 25 is a plan view of a trimmed resistor of a thick film type according to the ninth embodiment. This embodiment differs from the eighth embodiment in that the first external electrodes 62*a* connected with the resistor terminal and 70 respectively, are extended as each having a triangular portion on the insulation base board 61, and the apexes of the triangular portions are brought into contact with each other at a contact point 75. The other features are the same as in the eighth embodiment.

Figure 26:
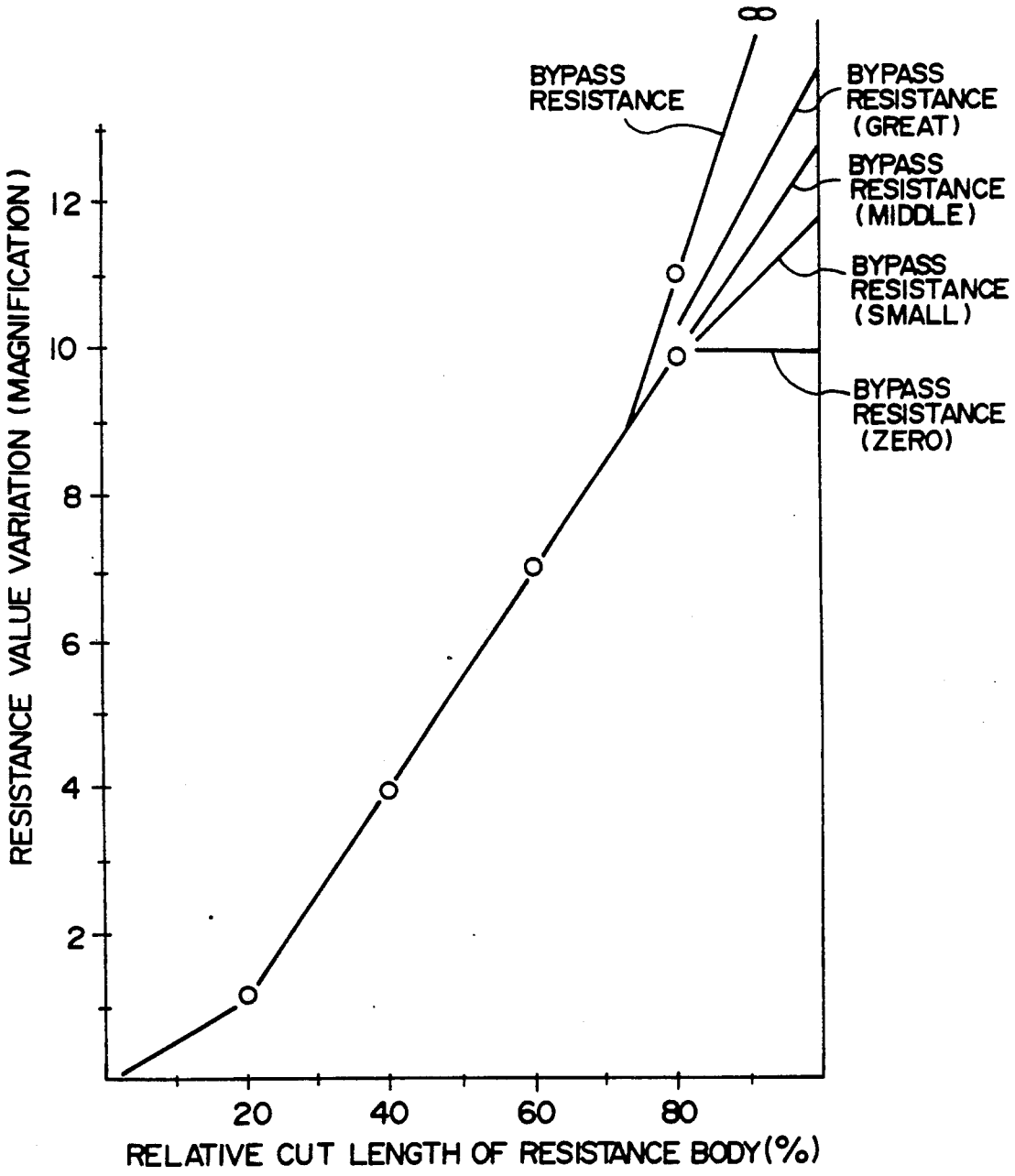
FIG. 26 shows characteristic curves of the resistance value variations in case of the ninth embodiment.

FIG. 26 shows characteristic curves of the resistance value variation between the resistor terminals 69 and 70, when the trimming is carried out. In this case, the trimming of the resistance body 63 is started from the contact point 75 of the first external electrodes 62*a*. Since the first external electrodes 62*a* are connected with each other as shown in FIG. 26, the resistance value starts from zero and smoothly increases under the function of the external electrodes each having a triangular portion, thereby making it possible to obtain a wide range of the resistance value variation. After then, the resistance value between the resistor terminals 69 and 70 increases with the same tendency as that shown in FIG. 24. This embodiment has an additional advantage, when compared with the eighth embodiment, that the area where the trimming can be actually carried out can be enlarged not only near the second external electrodes 62*b* but also near the first external electrodes 62*a*.

Figure 27:
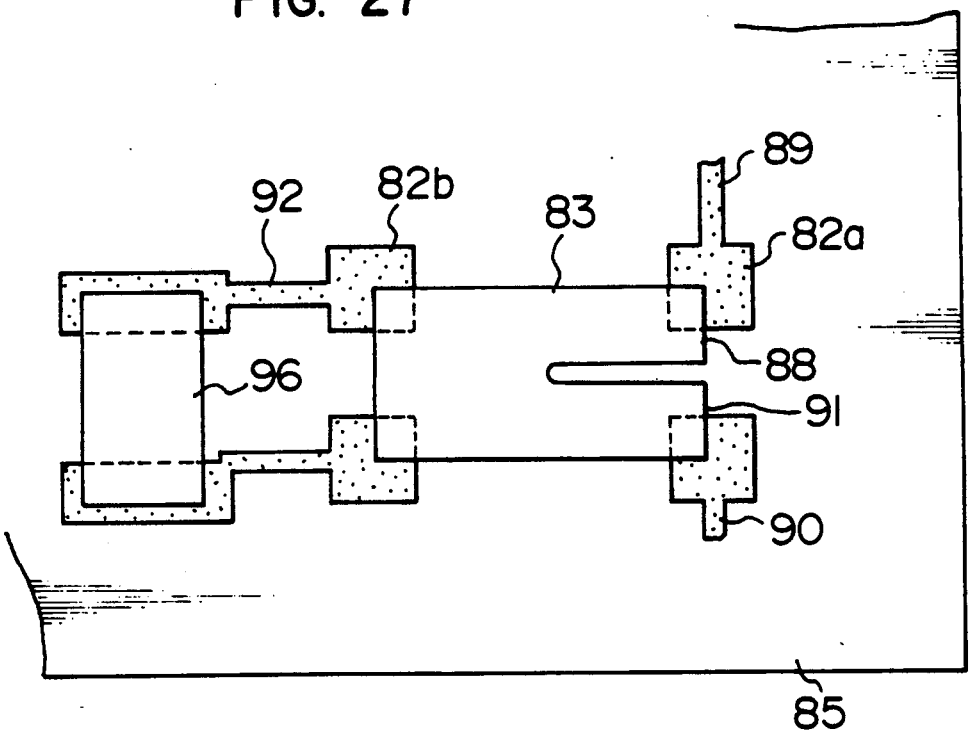
FIG. 27 is a plan view of a trimmed resistor of a thick film type according to a tenth embodiment.

FIG. 27 is a plan view of a thick film like printed resistance circuit of a trimming type according to a tenth embodiment of the present invention.

In FIG. 27, a circuit board 85 is mainly constituted by a alumina base plate and so on. A pair of external electrodes 82*a* and 82*b* and a wiring pattern 92 are made of a material of palladium-silver group by printing and baking of the same. The first external electrodes 82*a* at the right side serve as the resistor terminals 89 and 90, while the second external electrodes 82*b* at the left side are connected with each other through a wiring pattern 92 and a by pass resistance body 96. The thick film-like resistance body 83 is made of a material of ruthenium oxide group by printing and baking of the same. A cut slit 88 in the film-like resistance body 83 is formed by using an usual means such as a laser, a sand blast, and a cutter. The resistance value between the resistor terminals 89 and 90 under the influence of the trimming has a characteristics shown in FIG. 24, and the area where the trimming is practically possible is enlarged nearly to the second external electrodes 82*b*.

Figure 28:
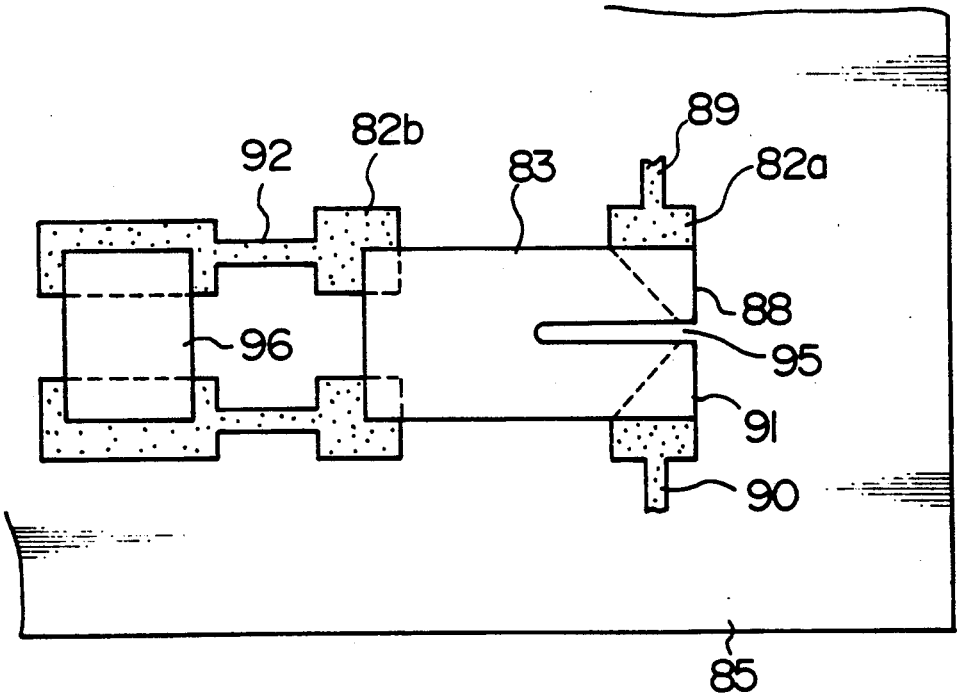
FIG. 28 is a plan view of a printed resistance circuit of a trimming type according to an eleventh embodiment.

FIG. 28 is a plan view showing an eleventh embodiment. The first external electrodes 82*a* serving as resistor terminals 89 and 90 are extended as each having a triangular portion on the printed board 85, and the apexes of the triangular portions connected with each other at a contact point 95. The other constituting members are the same as in the tenth embodiment. The characteristics of the resistance value variation between the resistor terminals 89 and 90 appearing when the film-like resistance body 83 is trimmed is the same as those shown in FIG. 26, and there can be obtained an advantage that the area where the trimming is practically possible is enlarged not only near the second external electrodes 82*b*, but also near the first external electrodes 82*a*.

Although, in the 8th–11th embodiments, thick film-like resistors of a trimmed type and printed resistance circuits of a thick film type for trimming have been described, other resistors of a thin film-like type or a polymer type, or resistors constituted by a resin base board also have the sam effects.

What is claimed is:

1. A trimmed resistor, comprising:

four external electrodes which are arranged at peripheral portions of a rectangular insulation base plate in a point symmetrical distribution about a vertical center line of a main surface of said insulation base plate, and a film-like resistance body which is formed on said insulation base plate and connected with all of said external electrodes, said resistance body including a cut slit extending along a longituding axis of said resistance body and between two adjacent ones of said external electrodes, whereby a resistance value of said resistance body between said two adjacent external electrodes is varied by said cut slit as a result of a variation of a sectional area and length of said resistance body between said two adjacent external electrodes.

2. A trimmed as claimed in claim 1, wherein ones of said external electrodes opposed to each other are extended on said main surface so that said opposed external electrodes are in contact with each other at a point on a longitudinal center line of said main surface.

3. A method of adjusting a resistance of a trimmed resistor comprising four external electrodes which are arranged at peripheral portions of a rectangular insulation base plate in a point symmetrical distribution about a vertical center line of a main surface of said insulation base plate, and a film-like resistance body which is connected with all of said external electrodes, wherein a resistance value among said external electrodes is varied by forming a cut slit in said film-like resistance body along a longitudinal axis of the resistance body and the external electrodes opposed to each other are extended on said main surface so that said opposed external electrodes are in contact with each other at a point on a longitudinal a center line of said main surface, comprising the steps of, connecting said four external electrodes of said trimmed resistor with four soft soldering lands formed on a printed base board by using soft solder, said soldering lands connected with said two opposed electrodes serving as terminals of said resistor, and forming a cut slit in said film-like resistance body, said cut slit extending longitudinally of the resistance body from an end of said two external electrodes connected with said resistor terminals for adjusting the resistance value between said resistor terminals.

4. A method as claimed in claim 3, wherein the soldering lands not serving as resistor terminals are connected with each other on said printed base board.

5. A method as claimed in claim 4, wherein said soldering lands connected with each other on the printed base board are used as an intermediate terminal of the resistor, and an equilibrium relation of the resistance values between the intermediate terminal and one of the two resistor terminals and between the intermediate terminal and the other of the two resistor terminals are adjusted by forming a cut slit having a wave shape in said film-like resistance body.

6. A trimmed resistor, comprising:

a first external electrode means and a second external electrode means, said second external electrode means comprising a pair of spaced apart electrodes, said first external electrode means and said second external electrode means being arranged symmetrically with respect to a center plane perpendicular to a main surface of a rectangular insulation base plate, a film-like resistance body which is formed on said insulation base plate and connects said first external electrode means and said second external electrode means with each other, said resistance body including a cut slit extending along a longitudinal axis of said resistance body and between said pair of electrodes into which said second external electrode means is divided, whereby a resistance value between said pair of electrodes is varied by said cut slit as a result of a variation of a section area and length of said resistance body between said pair of electrodes.

7. A method of adjusting a resistance of a trimmed resistor comprising four external electrodes which are arranged at peripheral portions of a rectangular insulation base plate in a point symmetrical distribution about a vertical center line of a main surface of said insulation base plate, and a film-like resistance body which si connected with all of said external electrodes, wherein a resistance value among said external electrodes is varied by forming a cut slit in said film-like resistance body along a longitudinal axis of the resistance body and the external electrodes opposed to each other are extended on said main surface so that said opposed external electrodes are in contact with each other at a point on a longitudinal a center line of said main surface, comprising the steps of:

connecting said four external electrodes of a trimmed resistor with four soft soldering lands formed on a printed base board by using soft solder, the soldering lands connected with said two opposed electrodes serving as terminals of said resistor, and forming a cut slit in said film-like resistance body, said cut slit extending longitudinally of the resistance body from an end of said two external electrodes connected with the resistor terminals for adjusting the resistance value between said resistor terminals.

8. A method as claimed in claim 7, wherein soldering lands not serving as resistor terminals are connected with each other on said printed base board.

9. A method as claimed in claim 8, wherein said soldering lands connected with each other on the printed base board are used as an intermediate terminal of the resistor, and an equilibrium relation of the resistance values between the intermediate terminal and one of the two resistor terminals and between the intermediate terminal and the other of the two resistor terminals are adjusted by forming a cut slit having a wave shape in said film-like resistance body.

10. A printed resistance circuit for trimming, comprising two electrodes used as resistor terminals and arranged on an insulation base plate so as to constitute a shorter side of a rectangle, two electrodes connected with each other through a conductive wire for by-passing, and a rectangular film-like resistance body connected with all of said four electrodes, said film-like resistance body being formed with a cut slit for trimming extending longitudinally of said rectangle from said shorter side along which said resistor terminals are arranged.

11. A printed resistance circuit for as claimed in claim 10, wherein each of said two electrodes used as resistor terminals has a triangular shape; an apex of one of the triangular electrodes is in contact with an apex of the other of the triangular electrodes; and said cut slit is cut as starting at said contact point.

12. A printed resistance circuit for trimming as claimed in claim 10, wherein said electrodes not used as resistor terminals are used as an intermediate terminal of the resistor, and an equilibrium relation of the resistance values between the intermediate terminal and one of the two resistor terminals and between the intermediate terminal and one of the two resistor terminals and between the intermediate terminal and the other of the two resistor terminals are adjusted by forming a cut slit having a wave shape in said film-like resistance body.

13. A printed resistance circuit for trimming, comprising two electrodes used as resistor terminals and arranged on an insulation base plate so as to constitute an end portion of a shorter side of a rectangle, an electrode constituting the other side of said rectangle and having the same breadth as the summed breadth of said two electrodes, and a rectangular film-like resistance body connected with all of said three electrodes, said film-like resistance body being formed with a cut slit for trimming, said cut slit extending longitudinally of said rectangle from said shorter side provided with said resistor terminals.

14. A trimmed resistor, comprising a film-like resistance body provided on an insulation base plate or on a printed base board, a pair of first external electrodes and a pair of second external electrodes each connected with said film-like resistance body, and a by-pass resistance body connecting said second external electrodes with each other, the resistance value between said first external electrodes being adjusted by forming a cut slit cutting a part of said film-like resistance body between said first electrodes.

15. A trimmed resistor as claimed in claim 14, wherein each of said first electrodes has a triangular shape; an apex of one of the triangular electrodes is in point-contact with an apex of the other of the triangular electrodes; and said cut slit extends as starting at said contact point.

16. A method of adjusting a resistance of a trimmed resistor comprising two external electrodes which are arranged symmetrically with respect to the center plane perpendicular to the main surface of a rectangular insulation base plate, and a film-like resistance body which connects said external electrodes with each other, wherein the resistance value between said external electrodes is varied by partially forming a cut slit in said film-like resistance body so as to cut one of said external electrodes, comprising the steps of:

connecting said four external electrodes of a trimmed resistor with four soft soldering lands formed on a printed base board by using soft solder, the soldering lands connected with said two opposed electrodes serving as terminals of said resistor, and forming a cut slit in said film-like resistance body, said cut slit extending longitudinally of the resistance body from an end of said two external electrodes connected with the resistor terminals for adjusting the resistance value between said resistor terminals.

17. A using method as in claim 16, wherein the soldering lands not serving as resistor terminals are connected with each other on said printed base board.

* * * * *